US008042348B2

(12) United States Patent
Nishikawa et al.

(10) Patent No.: US 8,042,348 B2
(45) Date of Patent: Oct. 25, 2011

(54) COOLING SYSTEM, CONTROL DEVICE, AND CONTROL PROGRAM

(75) Inventors: Kazufumi Nishikawa, Neyagawa (JP); Atsushi Ouchi, Takatsuki (JP)

(73) Assignee: Sanyo Electric Co., Ltd., Osaka (JP)

( * ) Notice: Subject to any disclaimer, the term of this patent is extended or adjusted under 35 U.S.C. 154(b) by 378 days.

(21) Appl. No.: 12/352,193

(22) Filed: Jan. 12, 2009

(65) Prior Publication Data

US 2009/0183519 A1 Jul. 23, 2009

(30) Foreign Application Priority Data

Jan. 18, 2008 (JP) ..... 2008-009860
Nov. 19, 2008 (JP) ..... 2008-295173

(51) Int. Cl.
*F25B 49/00* (2006.01)

(52) U.S. Cl. ..... 62/228.1; 62/126; 62/209

(58) Field of Classification Search ..... 62/125, 62/126, 129, 208, 209, 228.1, 228.3
See application file for complete search history.

(56) References Cited

U.S. PATENT DOCUMENTS 7,047,753 B2 * 5/2006 Street et al. ..... 62/126

FOREIGN PATENT DOCUMENTS

JP 10038349 A * 2/1998

* cited by examiner

*Primary Examiner* — Marc Norman
(74) *Attorney, Agent, or Firm* — NDQ&M Watchstone LLP

(57) ABSTRACT

A cooling system is provided in which an integrated controller 10 controls the compressor for compressing a refrigerant and at least one constituent device which is a separate device from the compressor and that constitutes a refrigerant circulation circuit together with the compressor. The integrated controller 10 has a control data generation unit 16 that controls the compressor using a compressor sensor for detecting a first physical value, which is a physical value of the refrigerant at the time of normal operations, and an abnormality detection unit 13 for detecting an abnormality of the compressor sensor. The control data generation unit 16 controls the compressor using a constituent device sensor for detecting a second physical value that is a physical value having a close correlation with the first physical value in place of the compressor sensor when the abnormality was detected by the abnormality detection unit 13.

3 Claims, 19 Drawing Sheets

FIG. 4

| PRIORITY | PRIORITY ORDER | DATA ITEM |
|---|---|---|
| 1 | 1 | OBTAIN SUBSTITUTE TEMPERATURE DATA |
| | 2 | SET SUCTION PRESSURE DATA |
| 2 | 1 | MEASURE SHOWCASE CONTROLLER A |
| | 2 | SET SHOWCASE CONTROLLER A |
| 3 | 1 | MEASURE SHOWCASE CONTROLLER B |
| | 2 | SET SHOWCASE CONTROLLER B |
| | 3 | MEASURE SHOWCASE CONTROLLER B |
| | 4 | SET SHOWCASE CONTROLLER B |
| | ⋮ | ⋮ |
| 4 | | |

WHEN ABNORMAL

FIG. 17A

| PRIORITY | PRIORITY ORDER | DATA ITEM | |
|---|---|---|---|
| 1 | 1 | OBTAIN SUBSTITUTE TEMPERATURE DATA | WHEN ABNORMAL |
| | 2 | SET SUCTION PRESSURE DATA | |
| 2 | 1 | MEASURE FRESH FISH SHOWCASE CONTROLLER | |
| | 2 | SET FRESH FISH SHOWCASE CONTROLLER | |
| | 1 | MEASURE DRESSED MEAT SHOWCASE CONTROLLER | |
| | 2 | SET DRESSED MEAT SHOWCASE CONTROLLER | |
| 3 | 1 | MEASURE SHOWCASE CONTROLLER A | |
| | 2 | SET SHOWCASE CONTROLLER A | |
| | 3 | MEASURE SHOWCASE CONTROLLER B | |
| | 4 | SET SHOWCASE CONTROLLER B | |
| | ⋮ | ⋮ | |
| 4 | | | |

FIG. 17B

| PRIORITY | PRIORITY ORDER | DATA ITEM | |
|---|---|---|---|
| 1 | 1 | OBTAIN SUBSTITUTE TEMPERATURE DATA | WHEN ABNORMAL |
| | 2 | SET SUCTION PRESSURE DATA | |
| 2 | 1 | MEASURE COMPRESSOR CONTROLLER | |
| | 2 | SET COMPRESSOR CONTROLLER | |
| | ⋮ | ⋮ | |
| 3 | 1 | MEASURE SHOWCASE CONTROLLER A | |
| | 2 | SET SHOWCASE CONTROLLER A | |
| | 3 | MEASURE SHOWCASE CONTROLLER B | |
| | 4 | SET SHOWCASE CONTROLLER B | |
| | ⋮ | ⋮ | |
| 4 | 1 | MEASURE CONDENSER CONTROLLER | |
| | 2 | SET CONDENSER CONTROLLER | |
| | ⋮ | ⋮ | |
| 5 | | | |

COOLING SYSTEM, CONTROL DEVICE, AND CONTROL PROGRAM

CROSS REFERENCE TO RELATED APPLICATIONS

This application claims priority based on 35 USC 119 from prior Japanese Patent Application No. P2008-009860 filed on Jan. 18, 2008 and prior Japanese Patent Application No. P2008-295173 filed on Nov. 19, 2008, the entire contents of which are incorporated herein by reference.

BACKGROUND OF THE INVENTION

1. Field of the Invention

The invention relates to a cooling system utilizing a compressor for compressing a refrigerant and a constituent device that constitutes a refrigerant circulation circuit together with the compressor, a control device, and a control program.

2. Description of Related Art

As a cooling system utilizing a refrigerant circulation circuit that circulates a refrigerant, an air conditioning system of an indoor space such as stores, and refrigeration and freezer system that refrigerates and freezes merchandizes within showcases installed at stores have been widely used in the past. The refrigerant circulation circuit utilized in such systems includes a compressor for compressing the refrigerant and a constituent device which is a separate device from the compressor that constitutes the refrigerant circulation circuit together with the compressor. Here, the constituent device is, for example, a heat exchanger of the air conditioning system and a showcase and a condenser of the refrigeration and freezer system.

It is common that the compressor has a sensor for detecting a suction pressure (or suction temperature etc.) of the compressor and the compressor is controlled according to the sensor value outputted by the sensor. Because of this, in a case that an abnormality such as a breakdown occurs to the sensor provided at the compressor, the compressor becomes uncontrollable.

As a technology to handle when an abnormality occurred to the sensor provided at the compressor, a cooling system such as described in Japanese Laid-Open No. 2002-188874 (Claim 1, FIG. 1) was proposed. In particular, at the cooling system described in Japanese Laid-Open No. 2002-188874, total of four sensors, that is, a suction pressure sensor, suction temperature sensor, discharge pressure sensor, and discharge temperature sensor are provided at the compressor.

When an abnormality occurred to one of the above four sensors in the cooling system of Japanese Laid-Open No. 2002-188874, the sensor value of the sensor in which the abnormality occurred is supplemented using the sensor values outputted by the remaining three sensors.

However, because it is necessary that a number of sensors are provided at the compressor in the cooling system of Japanese Laid-Open No. 2002-188874, the size of the compressor system was increased and its control became complex.

Also, the technique described in Japanese Laid-Open No. 2002-188874 cannot be applied to a case in which only one sensor is provided at the compressor, and therefore, in such a case, there was a problem that the operation of the compressor could not be continued appropriately when an abnormality occurred to the sensor provided at the compressor.

SUMMARY OF THE INVENTION

The invention was made in consideration of the above and it provides a cooling system, control device, and a control program that enable the compressor operation to continue appropriately when an abnormality occurred to a sensor provided at the compressor even in a case that a number of sensors are not provided at the compressor.

One aspect of the cooling system according to the invention includes a compressor (compressor 51) and at least one constituent device which is a separate device from the compressor (such as showcases 53, 54, and 55 . . . ) that constitutes a refrigerant circulation circuit together with the compressor. The cooling system also includes a compressor sensor (such as suction pressure sensor 51*d*) provided at the compressor which detects a first physical value as a first sensor value which is a physical value of the refrigerant (such as a suction pressure); a constituent device sensor (such as temperature sensors 53*b*, 54*b*, and 55*b* . . . ) provided at the constituent device for detecting a second physical value (such as an inside temperature of a showcase) which is a physical value having a close relationship with the first physical value either by being affected by the first physical value or affecting the first physical value; a compressor control unit (compressor controller 20) for controlling the compressor; and an abnormality detection unit (abnormality detection unit 13) for detecting an abnormality of the compressor sensor. The compressor control unit controls the compressor by utilizing the compressor sensor in normal operations. However, when the abnormality is detected at the abnormality detection unit, the compressor control unit controls the compressor by utilizing the constituent device sensor in place of the compressor sensor.

In such a cooling system, the constituent device sensor provided at the constituent device detects a physical value having a close relationship with the physical value of the refrigerant. Here, the close relationship means a relationship in which if one changes, the other also changes in response. As one example, in a case that the compressor sensor detects the suction pressure and the constituent device sensor detects the inside temperature of a showcase or the refrigerant pressure, the suction pressure of the compressor and the inside temperature of the showcase or the refrigerant pressure have a close relationship. In other words, the lower the suction pressure of the compressor is, the lower the inside temperature of the showcase becomes. In this case, the suction pressure of the compressor corresponds to the first physical value and the inside temperature of the showcase or the refrigerant pressure corresponds to the second physical value.

Therefore, even when an abnormality occurs to the compressor sensor, operations of the compressor can be continued appropriately by using the constituent device sensor in place of the compressor sensor.

Here, it is not necessary to provide a plurality of the compressor sensors and there can be just one compressor sensor. In other words, it is not necessary to provide a number of sensors at the compressor and thus, an increased size of the compressor system can be avoided. Also, in a case that only one sensor is provided at the compressor, if the abnormality occurred to the sensor provided at the compressor, the compressor can be controlled by using the constituent device sensor of a separate device, thus enabling continued compressor operations appropriately.

Moreover, in a case that the abnormality occurred to the sensor provided at the compressor, the existing constituent device sensor provided at the existing constituent device can be diverted to control the compressor. Therefore, it is not necessary to add a new sensor and it makes it possible to handle an occurrence of the abnormality to the sensor provided at the compressor while avoiding to increase the number of sensors.

In such a cooling system, it is preferable to provide a plurality of the constituent device sensors and further to provide a correlation coefficient computation unit (correlation coefficient computation unit 18) that computes for each constituent device sensor a correlation coefficient indicating the correlation between a first sensor value detected by the compressor sensor and a second sensor value detected by each of the constituent device sensors.

In such a cooling system, various controls are possible by using the correlation coefficients computed at the correlation coefficient computation unit. Further, a correlation coefficient computation unit (correlation coefficient computation unit 18) that computes a correlation coefficient indicating the correlation between the statistical value of the second sensor values detected by each of the constituent device sensors and the first sensor value in correspondence with the statistical value of the second sensor value may be provided.

In addition to the possible various controls utilizing the correlation coefficients computed by the correlation coefficient computation unit, it can compute the statistical value of the several sensor values in a lump and send the statistical value rather than sending the sensor values of all the constituent device sensors when sending the sensor values of the constituent device sensors. Therefore, the communication frequency and the transmission data volume on the communication lines can be reduced.

It is preferable further to provide a substitute sensor selection unit (substitute sensor selection unit 14) for selecting the constituent device sensor which detected the second sensor value having the most correlation with the first sensor value from the constituent device sensors as a substitute sensor to be used for controlling the compressor based on the correlation coefficient computed by the correlation coefficient computation unit using a correlation function.

In such a cooling system, the substitute sensor selection unit can select the constituent device sensor that detected the second physical value having the most correlation with the first physical value detected by the compressor sensor as a substitute sensor among the constituent device sensors, and therefore, an appropriate substitute sensor can be selected.

It is preferable that such a cooling system is provided with a plurality of constituent devices and an adjustment mechanism (such as flow controllers 53*e*, 54*e*, and 55*e* . . . ) provided at each of the constituent devices for adjusting the second physical value and a device specifying unit (device specifying unit 19) for specifying the constituent device with the adjustment mechanism having an optimum value of the degree to adjust the second physical value among the constituent devices based on adjustment amount information indicating the adjustment degree (such as valve opening degree).

If the degree of adjustment of the second physical value by the adjustment mechanism is optimum, the correlation between the first physical value and the second physical value becomes higher. On the other hand, the smaller the degree of the adjustment by the adjustment mechanism is, the sparse the correlation between the first physical value and the second physical value becomes.

Therefore, the device specifying unit specifies the constituent device with the adjustment mechanism having an optimum adjustment degree of the second physical value among the constituent devices. The constituent device sensor provided at the specified constituent device, therefore, is a sensor that detects the second physical value having the most correlation with the first physical value.

In the cooling system having such features, it is preferable that the substitute sensor selection unit selects the substitute sensor from the constituent device sensor provided at the constituent device that was specified by the device specifying unit using the correlation coefficient.

In such a cooling system, the substitute sensor selection unit selects the substitute sensor from the constituent device sensor provided at the constituent device that was specified by the device specifying sensor. As such, by specifying an appropriate constituent device from the constituent devices and further by selecting the substitute sensor from the constituent device sensors provided at that specified constituent device, a more appropriate substitute sensor can be selected.

It is preferable that the above cooling system is provided with a communication control unit (communication control unit 12) that transmits the second sensor value detected by the constituent device sensor to the compressor control unit and a plurality of device control units (showcase controllers 40*a*, 40*b*, and 40*c* . . . ), and that the communication control unit obtains the second sensor value from the device control units by communicating with the device control units. When the abnormality was detected by the abnormality detection unit, the communication control unit accords the device control unit that controls the constituent device having the substitute sensor priority over the other device control units as the subject of communication, and when the abnormality was detected by the abnormality detection unit, the communication control unit extracts important data including the second sensor value detected by the substitute sensor and accords the important data priority over normal data including second sensor values detected by the other constituent device sensors, and transmits to the compressor control unit by making transmit frequency of the important data higher than the transmit frequency of the normal data.

In such a cooling system, the communication control unit sequentially transmits the second sensor values detected by the constituent device sensors to the compressor control unit. When the number of the constituent device sensors is large, it takes a long time to transmit the second sensor values detected by all the constituent device sensors to the compressor control unit. In such a case, the cycle for transmitting the second sensor value detected by the substitute sensor to the compressor control unit becomes long and the compressor control unit cannot control the compressor appropriately when the abnormality was detected by the abnormality detection unit.

Thus, the communication control unit accords the second sensor value detected by the substitute sensor priority over the second sensor values detected by the other constituent device sensors in transmitting it to the compressor control unit. As such, the cycle for transmitting the second sensor value detected by the substitute sensor to the compressor control unit can be shortened, thus enabling the compressor control unit to control the compressor appropriately when the abnormality was detected by the abnormality detection unit.

Also, the communication control unit obtains the second sensor values from the device control units by communicating with the device control units that control the constituent devices. When the number of the device control units is large, it takes a long time to communicate with all the device control units. In such a case, the cycle for transmitting the second sensor value detected by the substitute sensor to the compressor control unit becomes long and the compressor control unit cannot control the compressor appropriately when the abnormality was detected by the abnormality detection unit.

Thus, the communication control unit accords the device control unit that controls the constituent device having the substitute sensor priority over the other device control units in making it a subject of communication. As such, the cycle for transmitting the second sensor value detected by the substitute sensor to the compressor control unit can be shortened, thus enabling the compressor control unit to control the compressor appropriately when the abnormality was detected by the abnormality detection unit.

It is preferable that the abnormality detection unit determines whether or not the degree of correlation between the first sensor and the second sensor fell below a predetermined standard based on the correlation coefficient computed by the correlation coefficient computation unit using the correlation function, and detects the abnormality when the degree of the correlation fell below the predetermined standard considering that the abnormality occurred.

Since the first physical value and the second physical value have a close correlation, the correlation coefficient between the first sensor value and the second sensor value should be essentially high when there is no abnormality in the compressor sensor.

Therefore, the abnormality detection unit determines whether or not the degree of correlation between the first sensor value and the second sensor value fell below the predetermined standard and considers that the abnormality occurred to the compressor sensor when the degree of correlation fell below the predetermined standard. Thus, the abnormality of the compressor sensor can be detected with high accuracy.

It is preferable that the compressor control unit controls the compressor such that an error between the first sensor value and a target value for the first physical value (such as a target suction pressure value) is decreased, and that the abnormality detection unit determines whether or not the error exceeds a predetermined threshold amount. When the error exceeded the predetermined threshold, the abnormality detection unit determines that the abnormality occurred to the compressor sensor.

The compressor control unit controls the compressor such that the error between the first sensor value and the target value for the first physical value is decreased. Therefore, the error is kept small when the compressor sensor is normal. On the other hand, the error increases when the abnormality occurred to the compressor sensor.

Therefore, the abnormality detection unit determines whether or not the error exceeded the predetermined threshold and determines that the abnormality occurred to the compressor sensor when the error exceeded the predetermined threshold. Thus, the abnormality of the compressor sensor can be detected with high accuracy.

It is further preferable to provide a notification unit (such as display unit 15) that notifies a user the effect that the abnormality was detected and that the substitute sensor was selected from the constituent device sensors when the abnormality was detected by the abnormality detection unit.

According to such a cooling system, when the abnormality was detected by the abnormality detection unit, the user can grasp the detection of the abnormality with the compressor sensor and the selection of the substitute sensor from the constituent device sensors. Thus, it can prompt the user to repair the compressor sensor and can contribute to an appropriate continued operation of the compressor.

The control device according to the invention (such as integrated controller 10) controls the compressor (compressor 51) for compressing the refrigerant and at least one constituent device (such as showcases 53, 54, and 55 . . . ) which is a separate device from the compressor and that constitutes the refrigerant circulation circuit together with the compressor. The control device includes the abnormality detection unit (abnormality detection unit 13) that detects the abnormality of the compressor sensor (such as suction pressure sensor 51*d*) which is provided at the compressor and is used for controlling the compressor and for detecting the first physical value which is a physical value of the refrigerant; and a control data generation unit (control data generation unit 16) that generates control data for controlling the compressor by using the value of the constituent device sensor (such as temperature sensors 53*b*, 54*b*, and 55*b* . . . ) which is provided at the constituent device and that detects the second physical value which is a physical value having a close correlation with the first physical value either being affected by the first physical value or affecting the first physical value when the abnormality was detected by the abnormality detection unit. According to such a control device, the same effect can be achieved as the cooling system as described above.

The control program according to the invention makes a computer that functions as a control device (such as integrated controller 10) for controlling the compressor (compressor 51) for compressing the refrigerant and at least one constituent device (such as showcases 53, 54, and 55 . . . ) which is a separate device from the compressor and that constitutes the refrigerant circulation circuit together with the compressor, to execute a procedure to detect the abnormality of the compressor sensor which is provided at the compressor and is used for controlling the compressor and for detecting the first physical value which is a physical value of the refrigerant; and a procedure to generate control data for controlling the compressor by using the value of the constituent device sensor which is provided at the constituent device and that detects the second physical value which is a physical value having a close correlation with the first physical value either being affected by the first physical value or affecting the first physical value when the abnormality was detected by the abnormality detection unit. According to such a control program, the same effect can be achieved as the cooling system as described above.

BRIEF DESCRIPTION OF THE DRAWINGS

FIG. 4 is a table configuration view of the priority and priority order table retained by a communication control unit according to the first embodiment.

FIGS. 17A and 17B are views showing specific examples of priority and priority order settings.

DETAILED DESCRIPTION OF EMBODIMENTS

Next, embodiments of the invention will be described with reference to the accompanying drawings below. The same or similar reference numbers are used for the same or similar parts. In the first to the third embodiments below, a system configuration for refrigerating and freezing merchandises inside showcases that are installed in a store will be explained.

First Embodiment

In this embodiment, (1) a general configuration of the whole cooling system, (2) configuration of the integrated controller, (3) operations of the integrated controller, and (4) operations and effects will be explained in that order.

(1) General Configuration of the Whole Cooling System

Figure 1:
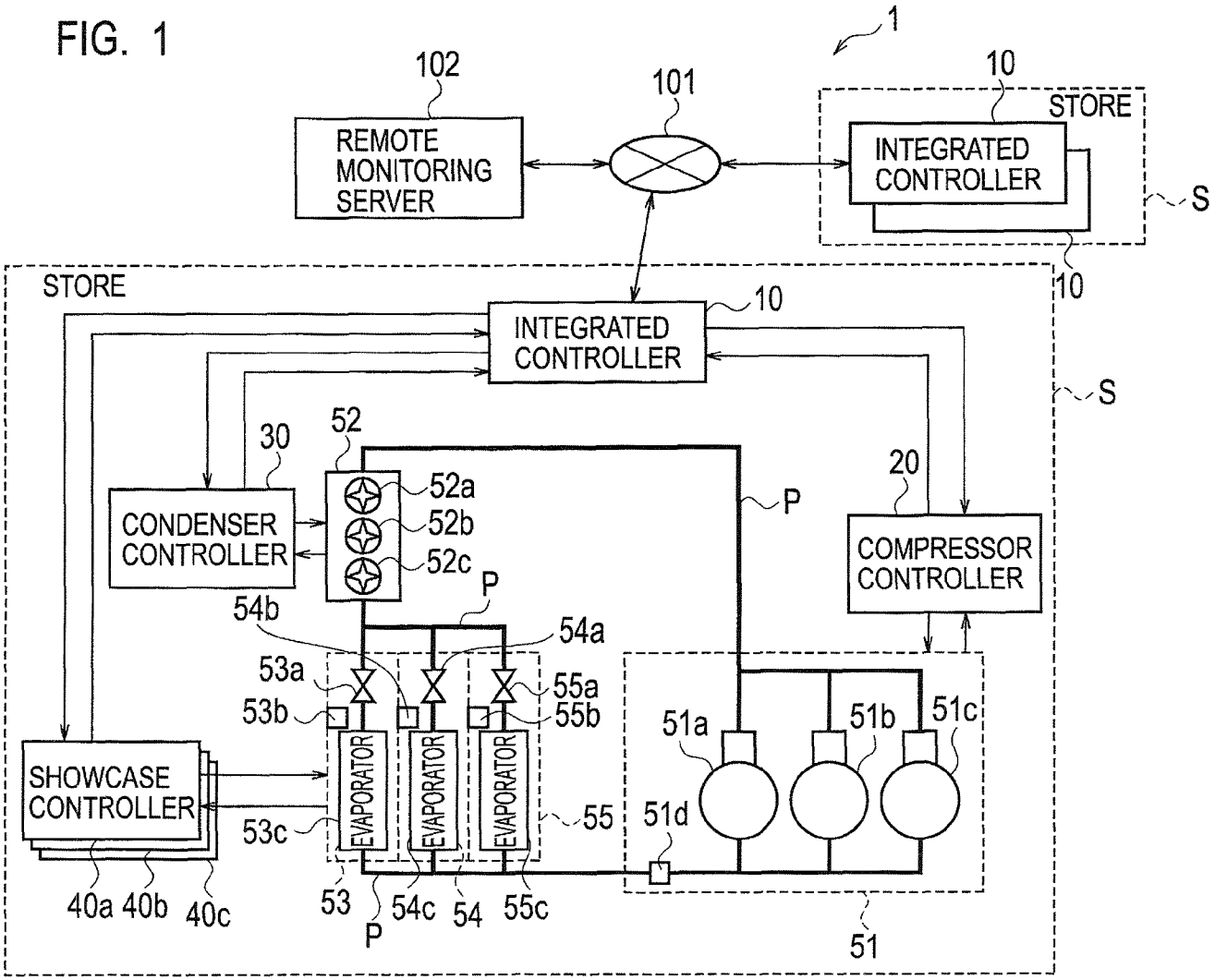
FIG. 1 is a general configuration diagram of the whole cooling system according to a first embodiment of the invention.

First, by referring to FIG. 1 and FIG. 2, the general configuration of the whole cooling system according to this embodiment will be explained. FIG. 1 is a general configuration view of the whole cooling system 1.

In this embodiment, a configuration having a remote monitoring server 102 that communicates with an integrated controller 10 installed at a plurality of stores S will be described. The remote monitoring server 102 obtains various data from the integrated controller 10 as well as transmits and sets various data to the integrated controller 10.

(1.1) Refrigerant Circulation Circuit

A refrigerant circulation circuit having a compressor 51, a condenser 52, showcases 53, 54, and 55, . . . , and refrigerant piping P is installed a store S. In this embodiment, each of the compressor 51, the condenser 52, and showcases 53, 54, and 55, . . . is a constituent device that constitutes the refrigerant circulation circuit, and is connected by the refrigerant piping P.

The compressor 51 includes three compressors 51*a* to 51*c* having respectively different compression abilities, and a suction pressure sensor 51*d* (compressor sensor). The suction pressure sensor 51*d* detects the pressure of the refrigerant taken in by the compressors 51*a* to 51*c*, that is, the suction pressure (a first physical value).

while a configuration utilizing the suction pressure sensor 51*d* will be described below, a suction temperature sensor for detecting the temperature of the refrigerant being taken in by the compressors 51*a* to 51*c* also may be used as the compressor sensor in place of the suction pressure sensor 51*d*. Alternatively, either a discharge pressure sensor for detecting the pressure of the refrigerant being discharged by the compressors 51*a* to 51*c* or a discharge temperature sensor for detecting the temperature of the refrigerant discharged by the compressors 51*a* to 51*c* also may be used as the compressor sensor.

The refrigerant compressed by the condenser 51 is lead to the condenser 52 via the refrigerant piping P. The condenser 52 has fans 52*a* to 52*c* and condenses the refrigerant using the fans 52*a* to 52*c*. The refrigerant condensed by the condenser 52 is lead to the showcases 53, 54, and 55 . . . .

The showcase 53 has an expansion valve 53*a*, a temperature sensor 53*b*, and an evaporator 53*c*. The refrigerant expanded at the expansion valve 53*a* evaporates at the evaporator 53*c* thus conducting heat away from inside the showcase 53. The expansion valve 53*a* also has a function to adjust the flow volume of the refrigerant. The evaporated refrigerant again is lead to the compressor 51 via the refrigerant piping P. By circulating the refrigerant as such, merchandises placed in the showcases 53, 54, and 55, . . . are cooled.

The temperature sensor 53*b* detects the inside temperature of the showcase 53. Alternatively, the temperature sensor 53*b* detects the temperature of the refrigerant flowing within the showcase 53. In the following explanations, the inside temperature of the showcase 53 and the temperature of the refrigerant flowing within the showcase 53 collectively will be called a "showcase temperature (second physical value)". Here, the showcase temperature and the suction pressure of the compressor 51 have a close correlation. In other words, the lower the suction pressure of the compressor is, the lower the showcase temperature becomes. However, a sensor for detecting the pressure of the refrigerant flowing the showcase 53 also may be used in place of the temperature sensor 53*b*.

As such, when the suction pressure or the suction temperature of the compressor 51 is the first physical value, as the second physical value having a close relationship with the first physical value, such physical values as the inside temperature of the showcase 53, the temperature of the refrigerant flowing in the showcase 53, or the pressure of the refrigerant flowing in the showcase 53 can be listed.

The showcases 54 and 55 . . . are similarly configured as the showcase 53. Although only three showcases are illustrated in FIG. 1, in reality a number of showcases may be installed according to the size of the store S.

In this embodiment, a configuration that can handle an instance in which an abnormality such as a breakdown occurred at the suction pressure sensor 51*d* will be explained.

(1.2) Controller

Various controllers are placed at the store S. In particular, at the store S, the compressor controller 20 that controls the compressor 51, showcase controllers 40*a*, 40*b*, and 40*c* . . . that controls the showcases 53, 54, and 55 . . . , and the integrated controller 10 are installed. The compressor controller 20, the condenser controller 30, the showcase controllers 40*a*, 40*b*, and 40*c* . . . arbitrarily will be called collectively as "device controllers".

The compressor controller 20 controls the compressor 51 such that the error between the sensor value outputted by the suction pressure sensor 51*d* ("suction pressure sensor value") and a target value for the suction pressure ("suction pressure target value") is decreased. The compressor controller 20 also has a function to put out an alarm or alert in a case that the error between the suction pressure sensor value and the suction pressure target value exceeded a predetermined value.

In a case that the suction temperature sensor is used in place of the suction pressure sensor 51*d* however, the compressor 51 is controlled based on the sensor value outputted by the suction temperature sensor.

The showcase controllers 40*a*, 40*b*, and 40*c* . . . control the showcases 53, 54, and 55 . . . (more precisely the expansion valves 53*a*, 53*b*, and 53*c* . . . ) based on the sensor values ("temperature sensor values") outputted by the temperature sensors 53*b*, 54*b*, and 55*b* . . . . The showcase controllers 40*a*, 40*b*, and 40*c* . . . also have a function to put out an alarm or alert when the error between the temperature sensor values and target values for the showcase temperatures exceeded predetermined values.

Although it is common to provide the showcase controllers 40*a*, 40*b*, and 40*c* . . . in one-to-one correspondence for the showcases 53, 54, and 55 . . . , one showcase controller may control a plurality of showcases also.

The integrated controller 10 performs mutual communication with the device controllers and systematically manages operation statuses of the constituent devices to coordinate among each constituent device. For example, the integrated controller 10 also has a function to perform an energy saving control in the entire store S. Also, the integrated controller 10 performs mutual communication with the remote monitoring server 102.

Figure 2:
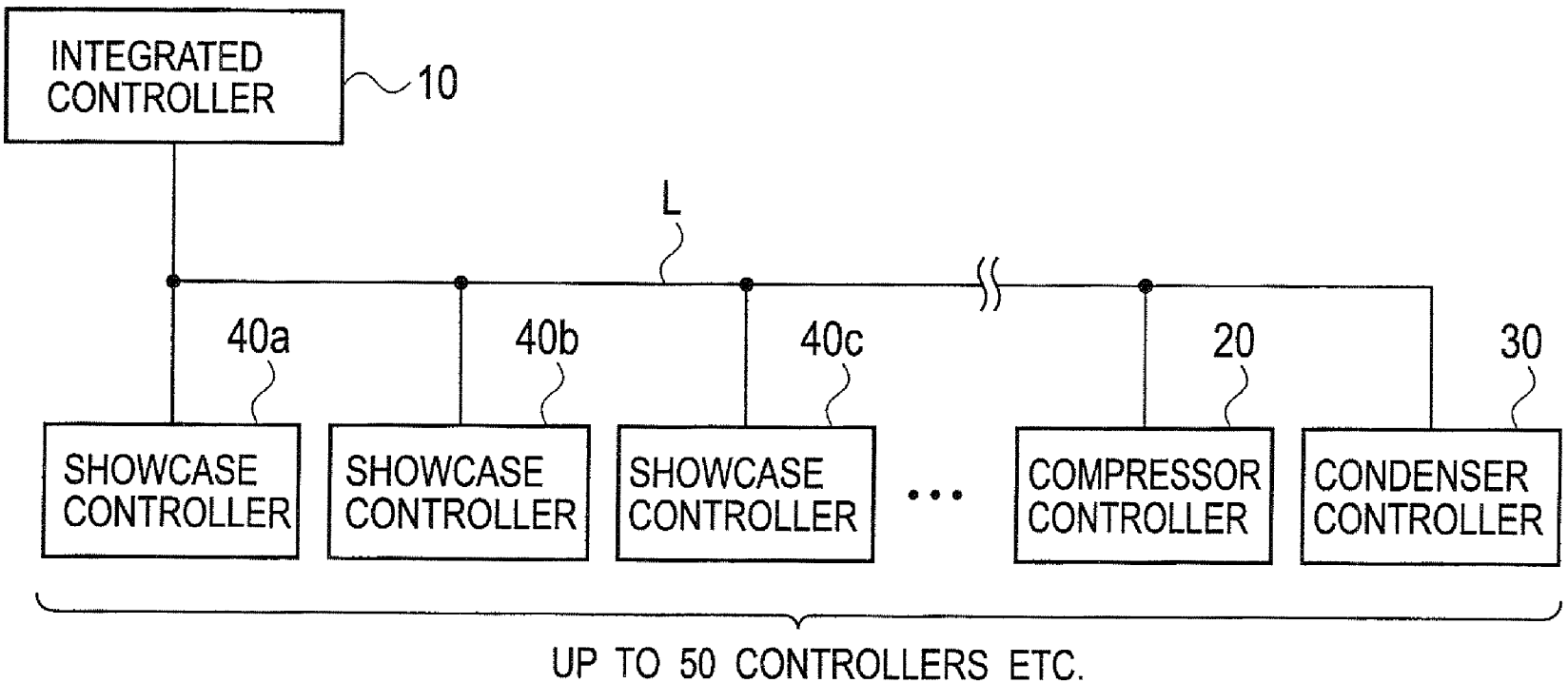
FIG. 2 is a view for explaining a communication configuration between an integrated controller and device controllers according to the first embodiment.

(1.3) Communication Configurations Between the Integrated Controller and the Device Controllers FIG. 2 is a view for explaining the communication configuration between the integrated controller 10 and the device controllers.

As shown in FIG. 2, the integrated controller 10 and the device controllers mutually communicate via a single transmission line L. This embodiment employs a master-slave system communication configuration with the integrated controller 10 as the master and the device controllers as the slave.

The integrated controller 10 communicates with each of the device controllers in sequence by polling. In particular, the integrated controller 10 obtains various sensor values and specifies control data used for controlling the constituent devices and the device controllers by polling. Because the integrated controller 10 communicates with each of the device controllers in sequence, it takes a long time to complete the communication with each of the device controllers in a case when a large number of device controllers (such as 50) are installed.

In this embodiment, a configuration will be explained in which the integrated controller 10 performs emergency operations using temperature sensor values obtained from the showcase controllers 40*a*, 40*b*, and 40*c* . . . in a case when the abnormality such as a breakdown occurred at the suction pressure sensor 51*d*, The integrated controller 10 and device controllers do not have to be connected by wireline and the integrated controller 10 and the device controllers also may communicate wirelessly.

(2) Configuration of the Integrated Controller

Next, by referring to FIGS. 3 to 7, a configuration of the integrated controller 10 will be explained. The integrated controller 10 is configured with a use of at least one computer having a CPU and a memory.

(2.1) Functional Block Configuration of the Integrated controller

Figure 3:
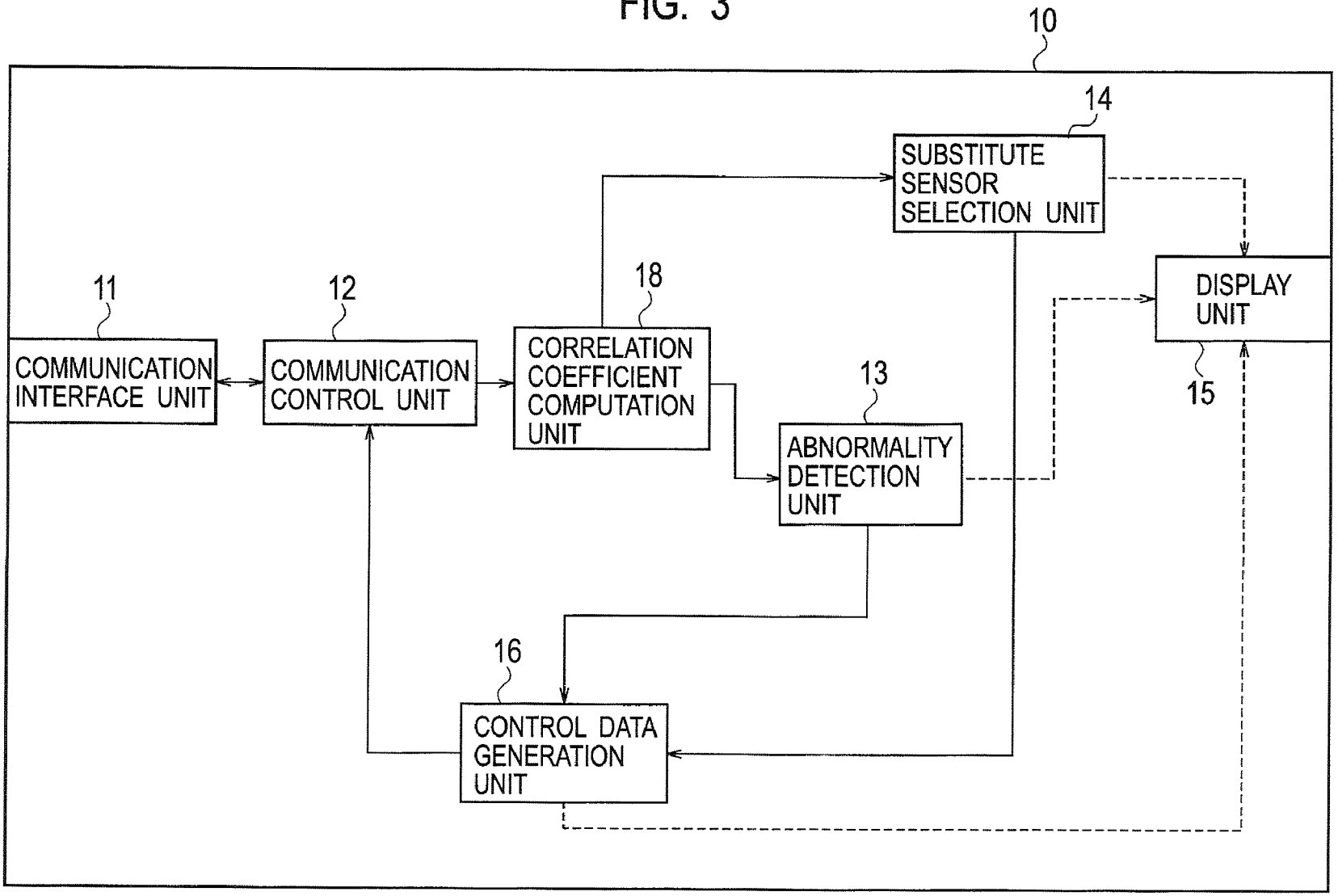
FIG. 3 is a functional block diagram of the integrated controller according to the first embodiment.

FIG. 3 is a functional block diagram of the integrated controller 10. The components relevant to the invention will be primarily explained below.

As shown in FIG. 3, the integrated controller 10 has a communication interface unit (communication I/F unit) 11, a communication control unit 12, a correlation coefficient computation unit 18, an abnormality detection unit 13, a substitute sensor selection unit 14, a display unit 15, and a control data generation unit 16.

The transmission line L is connected to the communication I/F unit 11. The communication I/F unit 11 functions as an interface with the device controllers as well as with the internet 101. The communication control unit 12 communicates with each device controller via the communication I/F unit 11 and the transmission line L.

The correlation coefficient computation unit 18 computes a correlation coefficient for each temperature sensor 53*b*, 54*b*, and 55*b* . . . based on a correlation function indicating the correlation between the suction pressure value and the temperature sensor value.

The abnormality detection unit 13 detects the abnormality of the suction pressure sensor 51*d* using the correlation coefficient. In particular, the abnormality detection unit 13 determines whether or not the degree of correlation between the suction pressure sensor value and the temperature sensor value fell below a predetermined standard based on the correlation coefficient computed by the correlation coefficient computation unit 18 and regards that the abnormality occurred at the suction pressure sensor 51*d* when the degree of correlation fell below the predetermined standard.

When the abnormality of the suction pressure sensor 51*d* was detected by the abnormality detection unit 13, the substitute sensor selection unit 14 selects a substitute sensor for controlling the compressor 51 in place of the suction pressure sensor 51*d* from the temperature sensors 53*b*, 54*b*, and 55*b* . . . using the correlation coefficient between the suction pressure sensor value and the temperature sensor values.

In this embodiment, the substitute sensor selection unit 14 selects the temperature sensor 53*b*, 54*b*, or 55*b* . . . that detected the temperature sensor value having the most correlation with the suction pressure sensor value from among the temperature sensor 53*b*, 54*b*, and 55*b* . . . based on the correlation coefficients computed by the correlation coefficient computation unit 18.

The control data generation unit 16 generates control data being sent to and set at the device controllers. Also, when the abnormality of the suction pressure sensor 51*d* was detected by the abnormality detection unit 13, the control data generation unit 16 generates a supplementation value for the suction pressure sensor value ("suction pressure sensor supplementation value") based on the temperature sensor value from the substitute sensor selected by the substitute sensor selection unit 14. Then, the communication control unit 12 sends and sets the suction pressure sensor supplementation value via the communication I/F unit 11 to control the compressor 51.

In this embodiment, the control data generation unit 16 or the compressor controller 20 controls the compressor 51 using the suction pressure sensor 51*d* at normal operations, and in a case when the abnormality of the suction pressure sensor 51*d* was detected by the abnormality detection unit 13, functions as a compressor control unit for controlling the compressor 51 using the temperature sensor 53*b*, 54*b*, or 55*b* . . . in place of the suction pressure sensor 51*d*.

The communication control unit 12 obtains temperature sensor values from the showcase controllers 40*a*, 40*b*, and 40*c* . . . by communicating with the showcase controllers 40*a*, 40*b*, and 40*c* . . . by polling.

When the abnormality of the suction pressure sensor 51*d* was detected by the abnormality detection unit 13, the communication control unit 12 accords the showcase controller that controls the showcase having the substitute sensor among the showcase controllers 40*a*, 40*b*, and 40*c* . . . priority over the other showcase controllers as the subject of communication.

Further, when the abnormality of the suction pressure sensor 51*d* was detected by the abnormality detection unit 13, the communication control unit 12 accords important data containing the temperature sensor value detected by the substitute sensor priority over normal data containing temperature values detected by the other temperature sensors.

When the abnormality of the suction pressure sensor 51*d* was detected by the abnormality detection unit 13, the display unit 15 functions as a notification unit for notifying to a user the effect that the abnormality was detected, that a substitute sensor was selected among the temperature sensors 53*b*, 54*b*, and 55*b* . . . , and the sensor supplementation value generated by the control data generation unit 16. However, notification to the user does not have to be made by the display and instead it may also be an audio notification to the user.

(2.2) Abnormality Detection Processing and Substitute Sensor Selection Processing Next, abnormality detection processing performed by the abnormality detection unit 13 will be described in details.

The communication control unit 12 monitors the showcases 53, 54, and 55 . . . and extracts sensor values of each temperature sensor of the showcases for which defrosting is not performed. Here, defrosting means temporarily stopping operations of a showcase and removing frost adhered to the showcase.

The correlation coefficient computation unit 18 obtains a degree of correlation between the temperature sensor value of each temperature sensor for the showcase to which defrosting is not performed and the suction pressure sensor value of the suction pressure sensor 51*d*. For example, when three out of ten showcases are defrosted, correlation coefficients and regression lines of the most recent 100 data (n=100) are computed for the temperature sensors of the remaining seven showcases.

The regression line is a graph of the computed suction pressure sensor value having a high correlation with the temperature sensor value, and it is not limited to a straight line. For example, it may also be a curved line such as a high-dimensional function, exponential function and logarithmic function, and sine-wave curve.

Here, for each temperature sensor of the showcases that are not defrosted, if the most recent n number of temperature sensor values is $X_n$, and the most recent n number of suction pressure sensor values of the suction pressure sensor 51*d* is $y_n$, it can be shown as the following table.

TABLE 1

| | 1 | 2 | 3 | . . . | n |
|---|---|---|---|---|---|
| Temperature sensor | $x_1$ | $x_2$ | $x_3$ | . . . | $x_n$ |
| Suction pressure sensor | $y_1$ | $y_2$ | $y_3$ | . . . | $y_n$ |

For example, the correlation coefficient r is computed using the following formula (1).

$$r = \frac{\sum_{i=1}^{n}(x_i - m_x)(y_i - m_y)}{\sqrt{\sum_{i=1}^{n}(x_i - m_x)^2 \sum_{i=1}^{n}(y_i - m_y)^2}} \tag{1}$$

(Here, $m_x$ and $m_y$ are mean valuesof $x$ and $y$ respectively.)

The regression line y at that time can be expressed by the following formula (2).

$$y = ax + b \tag{2}$$

In the formula (2), "a" and "b" can be expressed by the following formula (3).

$$a = \frac{\sum_{i=1}^{n} x_i^2 \sum_{i=1}^{n} y_i^2 - \sum_{i=1}^{n} x_i \sum_{i=1}^{n} x_i y_i}{n\sum_{i=1}^{n} x_i^2 - \left(\sum_{i=1}^{n} x_i\right)^2}, \tag{3}$$

$$b = \frac{n\sum_{i=1}^{n} x_i y_i - \sum_{i=1}^{n} x_i \sum_{i=1}^{n} y_i}{n\sum_{i=1}^{n} x_i^2 - \left(\sum_{i=1}^{n} x_i\right)^2}$$

Using the formulae (1) to (3), the correlation coefficient computation unit 18 computes the correlation coefficient r and the regression line y.

The abnormality detection unit 13 compares the correlation coefficient r computed for each temperature sensor by the correlation coefficient computation unit 18 with a predetermined standard (such as 0.9). The abnormality detection unit 13 determines that the abnormality occurred to the suction pressure sensor 51*d* when the correlation coefficient r for each temperature sensor fell below the predetermined standard.

Once it is determined that the abnormality occurred to the suction pressure sensor 51*d*, the substitute sensor selection unit 14 selects the temperature sensor having the most correlation as the substitute sensor among each temperature sensor of the showcases that are not defrosted.

Once the substitute sensor is selected, the control data generation unit 16 computes the suction pressure sensor value of the suction pressure sensor 51*d* from the temperature sensor value of the substitute sensor. In particular, the control data generation unit 16 converts the temperature sensor value x newly obtained from the substitute sensor to the suction pressure sensor supplementation value using the regression line y corresponding to the substitute sensor. In other words, in the formula (2), by substituting x with the sensor value x newly obtained from the substitute sensor, the suction pressure sensor supplementation value is computed.

The communication control unit 12 sends and sets the computed suction pressure sensor supplementation value to the compressor controller 20. Then, the compressor controller 20 receives the command from the communication control unit 12, determines that the abnormality occurred to the suction pressure sensor 51*d*, and controls the compressor 51 using the received suction pressure sensor supplementation value.

(2.3) Data Communication Processing

Next, the data communication processing performed by the communication control unit 12 will be explained.

As described above, the integrated controller 10 and the device controllers are connected by the single transmission line L, and therefore, the integrated controller 10 is capable of communicating only with one device controller at the same time. Thus, the communication control unit 12 communicates by setting priority and priority order for each device controller and further for each data item within the device controller.

Such prioritized communication may be performed only when the abnormality occurred to the suction pressure sensor 51*d*, that is, at the time of emergency operations. However, it also may be applicable at the time of normal operations.

FIG. 4 is a table configuration of the priority and priority order table retained by the communication control unit 12.

In FIG. 4, the smaller the number is, the higher priority and priority order it has. The priority and priority order table can be set and changed arbitrarily by the user. Specific examples of the priority and priority order table will be described in more detail below.

The communication control unit 12 performs polling based on the priority and priority order table as shown in FIG. 4. However, the items having priority 1 apply only at the time that the abnormality of the suction pressure sensor 51*d* was detected by the abnormality detection unit 13. In other words, the items of priority 1 are not used at normal operations.

Each item of priority 1 defines obtaining the temperature sensor value outputted by the substitute sensor and setting up the suction pressure sensor supplementation value to the compressor controller 20. When the abnormality of the suction pressure sensor 51*d* was detected by the abnormality detection unit 13, continuous operations of the compressor 51 becomes possible because the communication control unit 12 performs polling of each item in priority 1 before the other items.

Figure 5:
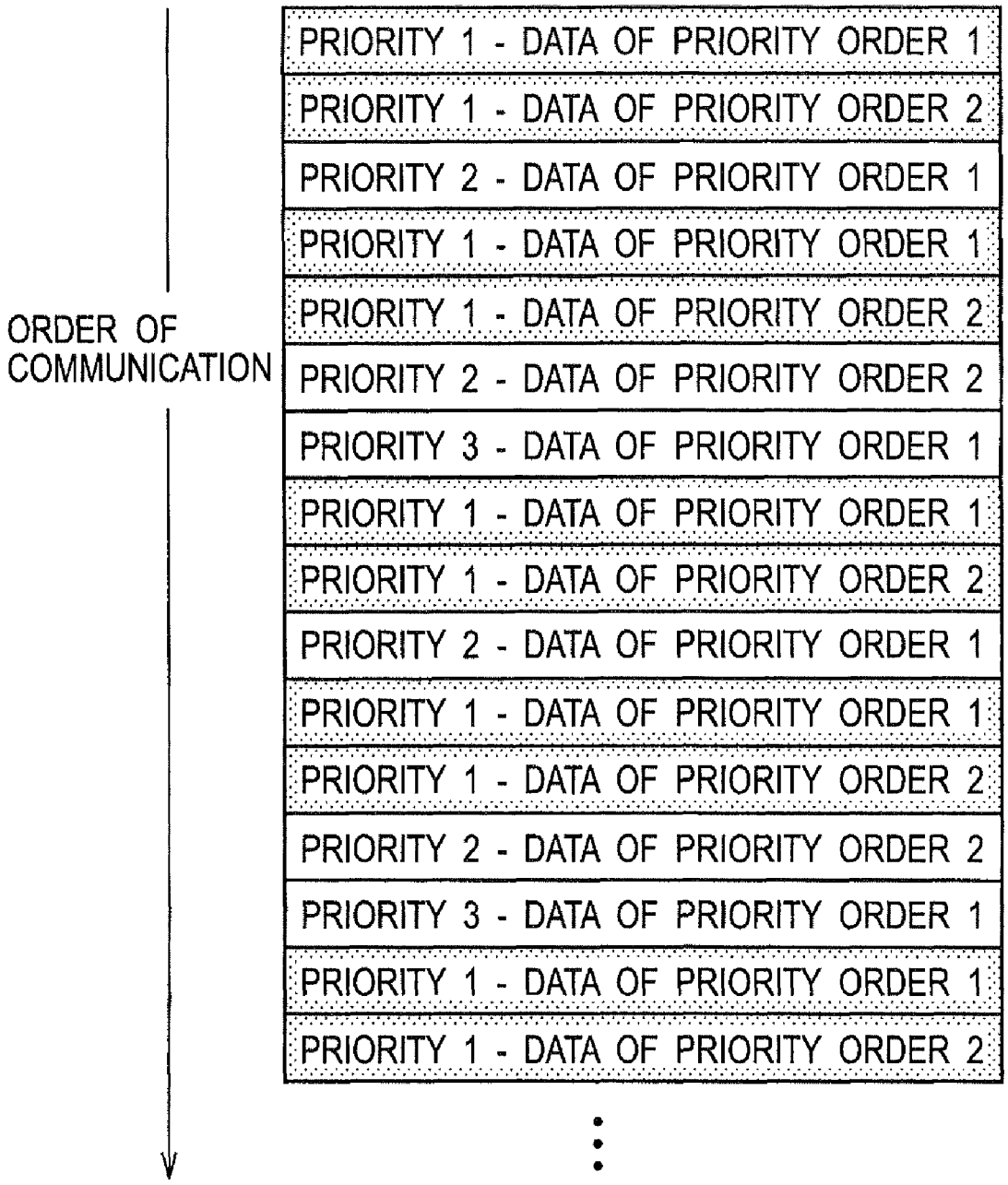
FIG. 5 is a concept view showing a communication order in a case that an abnormality of the suction pressure sensor was detected by an abnormality detection unit according to the first embodiment.

FIG. 5 is a conceptual view showing the communication order in a case when the abnormality of the suction pressure sensor 51*d* was detected by the abnormality detection unit 13.

As shown in FIG. 5, the communication control unit 12 performs polling according to the priority and priority order table as shown in FIG. 4. In particular, polling is performed from the item in priority order 1 of priority 1. Then, polling is performed for the item in priority order 2 of priority 1. When polling is completed for all the items in priority 1, the communication control unit 12 performs polling of the item in priority order 1 of priority 2.

When polling for the item in priority order 1 of priority 2 is completed, the communication control unit 12 again performs polling of each item in priority 1. Then, when polling for all the items in priority 2 are completed, the communication control unit 12 performs polling for the item in priority order 1 of priority 3. As such, the communication control unit 12 performs polling according to the priority and priority order and repeats these operations.

Figure 6:
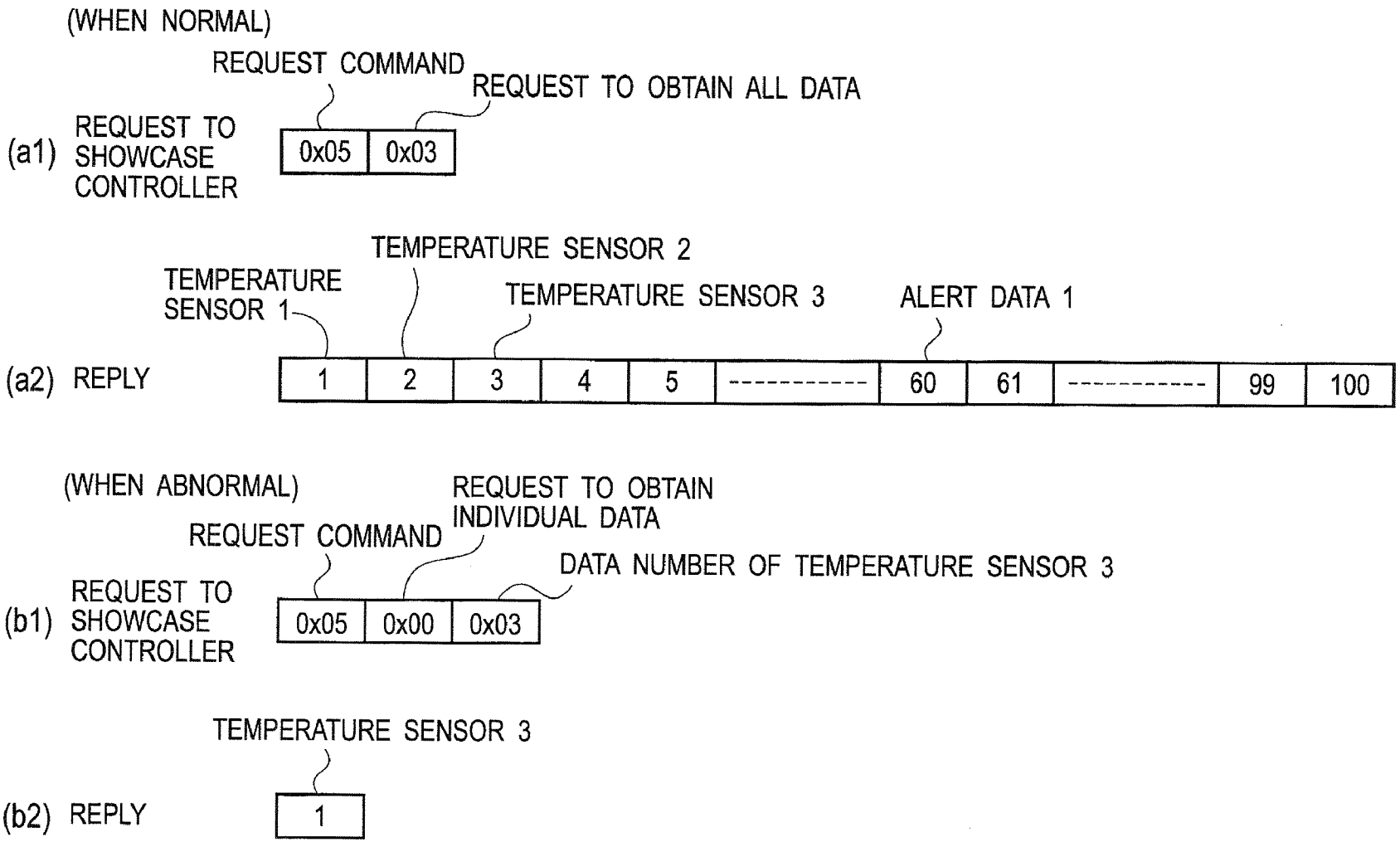
FIG. 6 is a message configuration view showing a request message to the showcase controller and a format of a reply message according to the first embodiment.

FIG. 6 is a message configuration view showing message formats of request messages to the showcase controller and reply messages. The communication control unit 12 performs polling using the messages in a format as shown in FIG. 6.

The request message format as shown at (a1) of FIG. 6 is used at the time of normal operations, and it has a field for storing a request command (here, it is 0x05) and a field for storing a request for obtaining all data (here, it is 0x03).

The reply message format as shown at (a2) of FIG. 6 is used at the time of normal operations, and it has fields 1 to 59 for storing temperature sensor values and fields 60 to 100 for storing alert data. The alert data is used for example when the error between the temperature sensor value and the target value for the showcase temperature exceeded a predetermined value. The reply message format as shown at (a2) of FIG. 6 has 100 fields and contains the total of 200 bytes when each field contains 2 bytes. It means that at normal operations a reply from the showcase controllers 40*a*, 40*b*, and 40*c* . . . to the integrated controller 10 takes a long time.

The message format as shown at (b1) of FIG. 6 is used at the time of emergency operations, and it has a field for storing a request command (here, it is 0x05), a field for storing a request for obtaining individual data (here, it is 0x00), and a field for storing identifying information for the substitute sensor (here, it is a data number of the temperature sensor 3). In other words, at emergency operations, it is possible to specify and obtain the temperature sensor value of the substitute sensor.

The reply message format as shown at (b2) of FIG. 6 is used at the time of emergency operations, and it has a field for storing the sensor value of the substitute sensor. In the reply message format as shown at (b2) of FIG. 6, the data amount is considerably decreased compared with the reply message format as shown at (a2) of FIG. 6. Therefore, at the time of emergency operations, a reply from the showcase controllers 40*a*, 40*b*, and 40*c* . . . to the integrated controller 10 can be completed in a short time.

(2.4) Example of Display Screen

Figure 7:
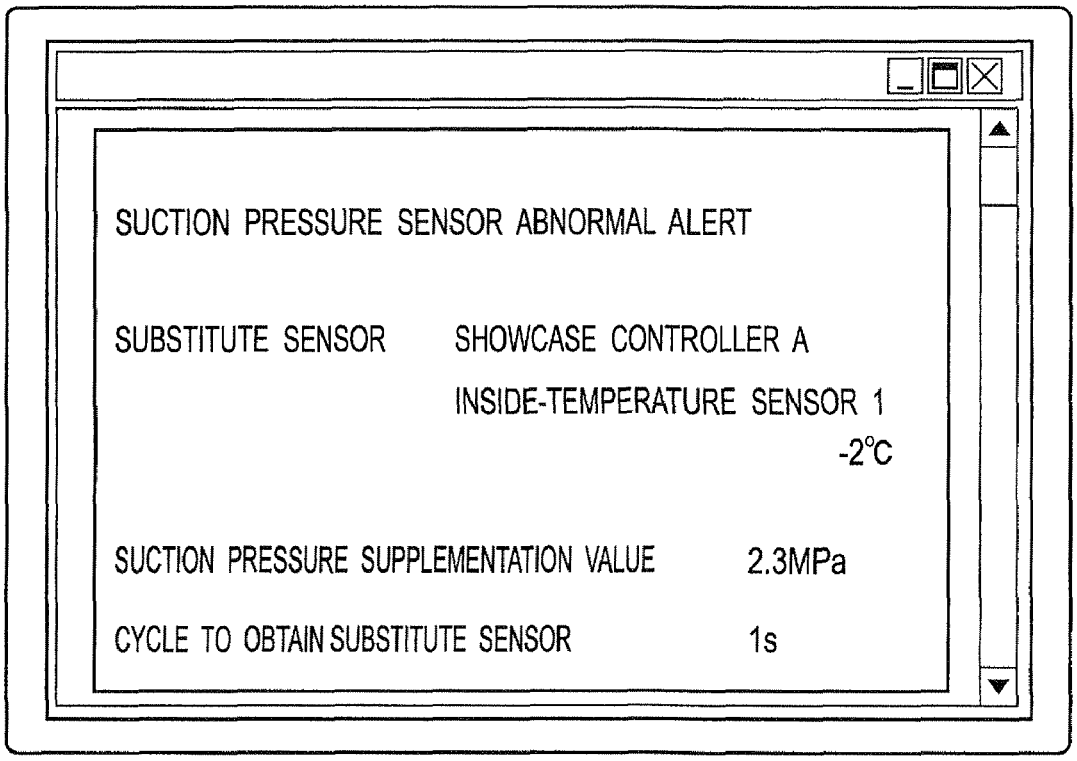
FIG. 7 is a view showing an example of the display screen displayed by a display unit according to the first embodiment.

Next, an example of a display screen displayed at the display unit 15 will be explained. FIG. 7 is a view showing an example of the display screen displayed by the display unit 15.

As shown in FIG. 7, when the abnormality of the suction pressure sensor 51*d* was detected by the abnormality detection unit 13, the display unit 15 displays the effect that it is under emergency operations (the occurrence of an abnormality of the suction pressure sensor 51*d*), identifying information of the substitute sensor selected by the substitute sensor selection unit 14 (sensor name in FIG. 7), the suction pressure sensor supplementation value computed by the control data generation unit 16, and the obtaining cycle of the substitute sensor. In FIG. 7, identifying information of the showcase controller having the substitute sensor also is displayed.

The remote monitoring server 102 as shown in FIG. 1 also may display a screen similar to that of FIG. 7. In this case, it becomes possible to grasp the abnormality of the suction pressure sensor 51*d* at a remote location of the store S.

(3) Operations of the Integrated Controller

Next, by referring to FIGS. 8 to 10, operations of the integrated controller 10 will be explained.

(3-1) Operations of the Integrated Controller

Figure 8:
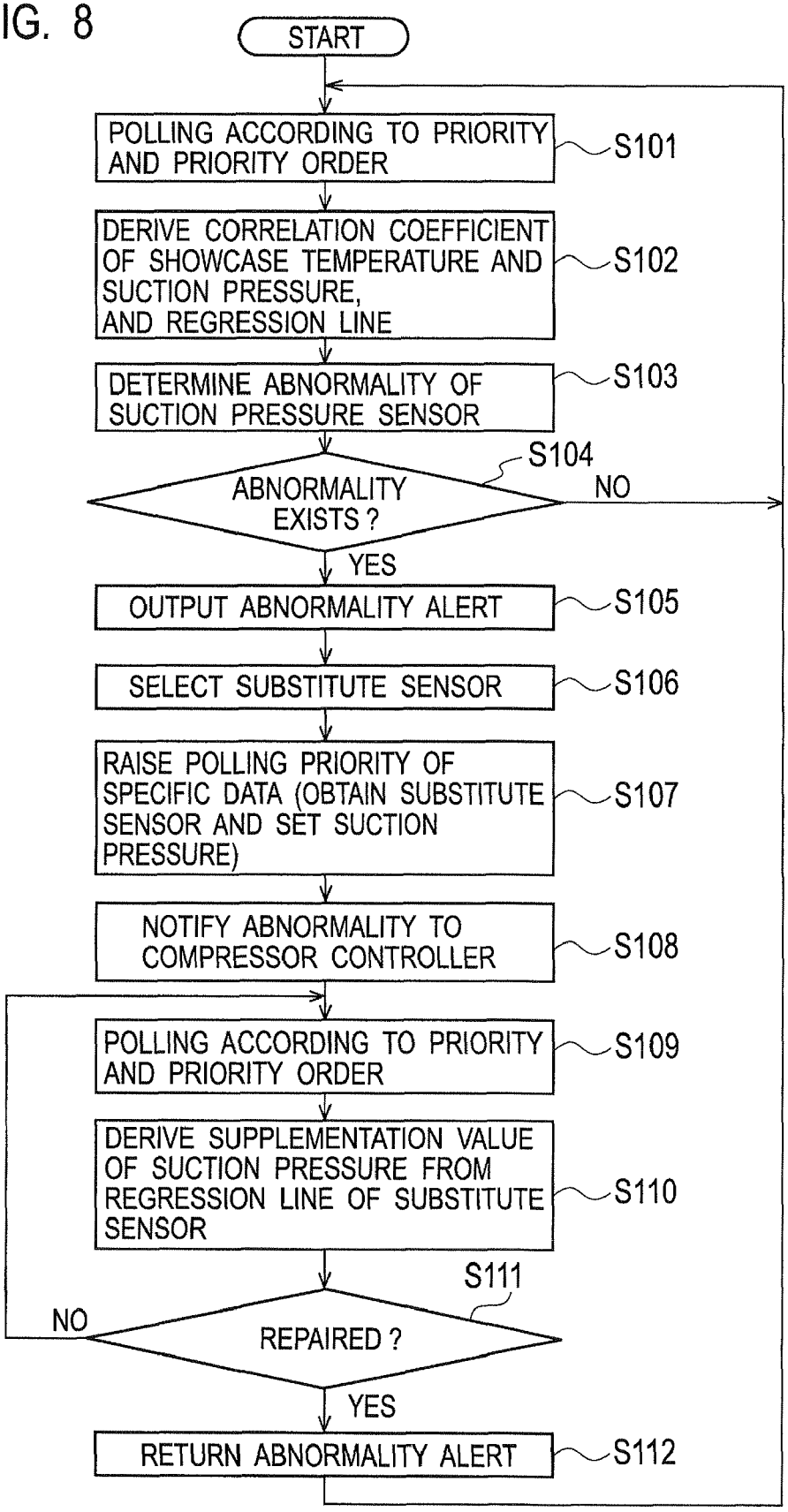
FIG. 8 is a flowchart showing operations of the integrated controller according to the first embodiment.

FIG. 8 is a flowchart showing operations of the integrated controller 10.

At step S101, the communication control unit 12 performs polling according to the priority and priority order as described above. However, the polling performed here does not use each item of priority 1.

At step S102, the correlation coefficient computation unit 18 derives correlation coefficients and regression lines according to the formulae (1) to (3).

At step S103, the abnormality detection unit 13 determines the abnormality of the suction pressure sensor 51*d* using the correlation coefficients obtained at step S102. Then at step S104, when it is determined that the abnormality occurred to the suction pressure sensor 51*d*, the process moves to step S105. On the other hand, when it is determined that the abnormality has not occurred to the suction pressure sensor 51*d*, the process goes back to step S101.

At step S105, the display unit 15 displays the effect that the abnormality occurred to the suction pressure sensor 51*d* as an abnormality alert.

At step S106, the substitute sensor selection unit 14 selects the substitute sensor used for controlling the compressor 51 in place of the suction pressure sensor 51*d* from among the temperature sensors 53*b*, 54*b*, and 55*b* . . . based on the correlation coefficients between the suction pressure sensor value and the temperature sensor values.

At step S107, the communication control unit 12 switches to polling using each item in priority 1 in the above-described priority and priority order.

At step S108, the communication control unit 12 notifies the compressor controller 20 the effect that the abnormality occurred. Then the compressor controller 20 stops control of the compressor using the suction pressure sensor 51*d*.

At step S109, the communication control unit 12 performs prioritized polling placing the items in priority 1 ahead of the other items according to the priority and priority order as described above.

At step S110, the control data generation unit 16 computes the suction pressure sensor supplementation value using the regression lines obtained at step S102.

At step S111, whether or not the suction pressure sensor 51*d* was repaired is determined. If the suction pressure sensor 51*d* was repaired, the process moves to step S112. If the suction pressure sensor 51*d* has not been repaired, the process goes back to step S109.

At step S112, the display unit 15 stops displaying the emergency alert. Also, the compressor controller 20 resumes control of the compressor 51 using the suction pressure sensor 51*d*.

(3.1) Data Communication Operations

Next, the data communication sequence that is carried out between the integrated controller 10 and the device controllers will be explained.

(3.1.1) Data Communication Operations at the Time of Normal Operations

Figure 9:
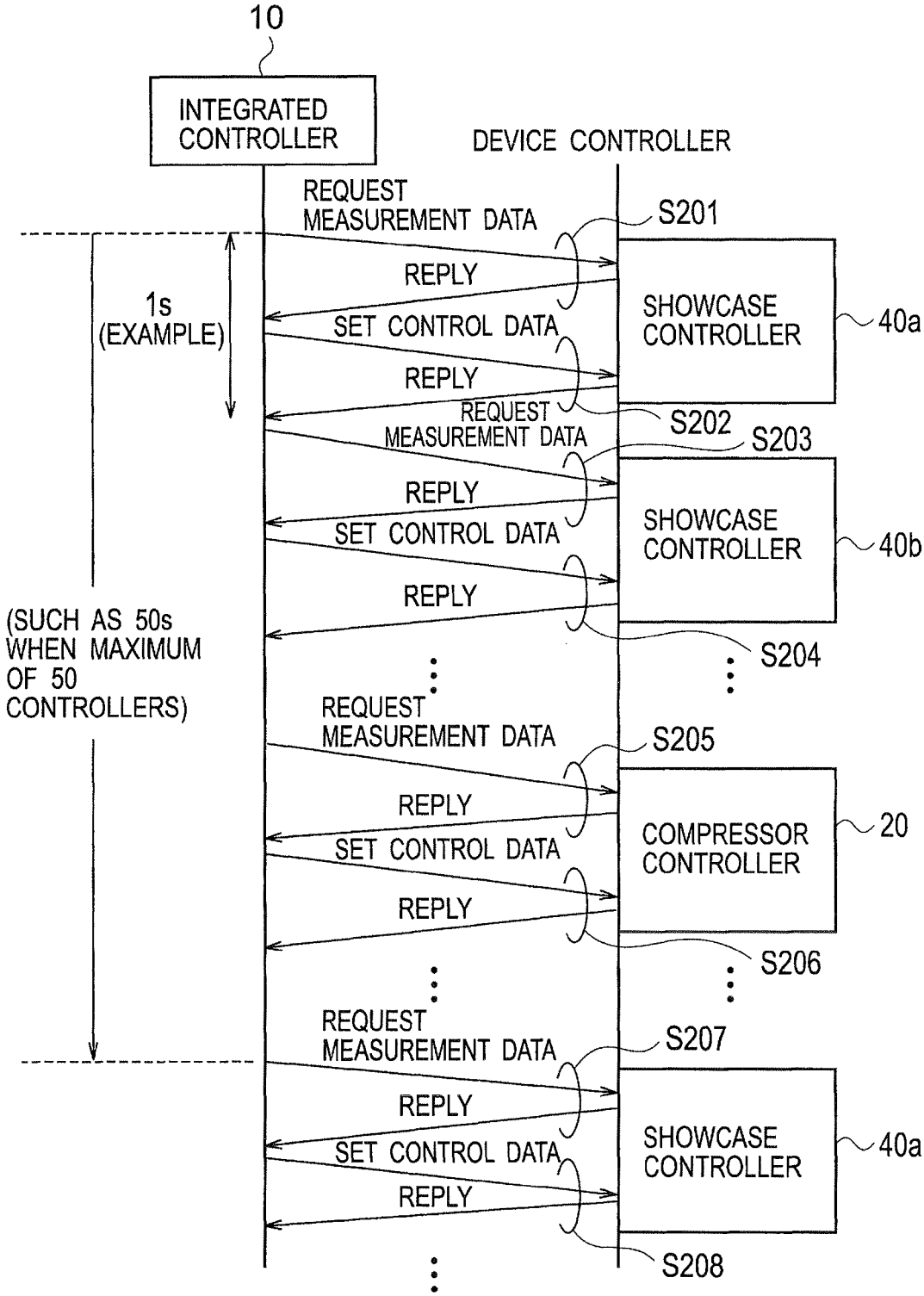
FIG. 9 is a sequential view showing a data communication sequence at the time of normal operations according to the first embodiment.

FIG. 9 is a sequential view showing the data communication sequence. Here, the explanation will be made in a case that the integrated controller 10 communicates with each device controller in sequence.

At step S201, the integrated controller 10 sends a request message requesting the temperature value (measured data) to the showcase controller 40*a*. The showcase controller 40*a* sends a reply message to the integrated controller 10.

At step S202, the integrated controller 10 sends a request message requesting to set up the control data to the showcase controller 40*a*. The showcase controller 40*a* sends a reply message to the integrated controller 10. At this time, the reply message format as shown at (a2) of FIG. 6 is used and the processes of step S201 and S202 take about 1 second.

After step S203, the integrated controller performs polling for the remaining device controllers. As a result, it requires a long time to complete the polling for all the device controllers.

(3.1.2) Data Communication Operations at the Time of Emergency Operations

Figure 10:
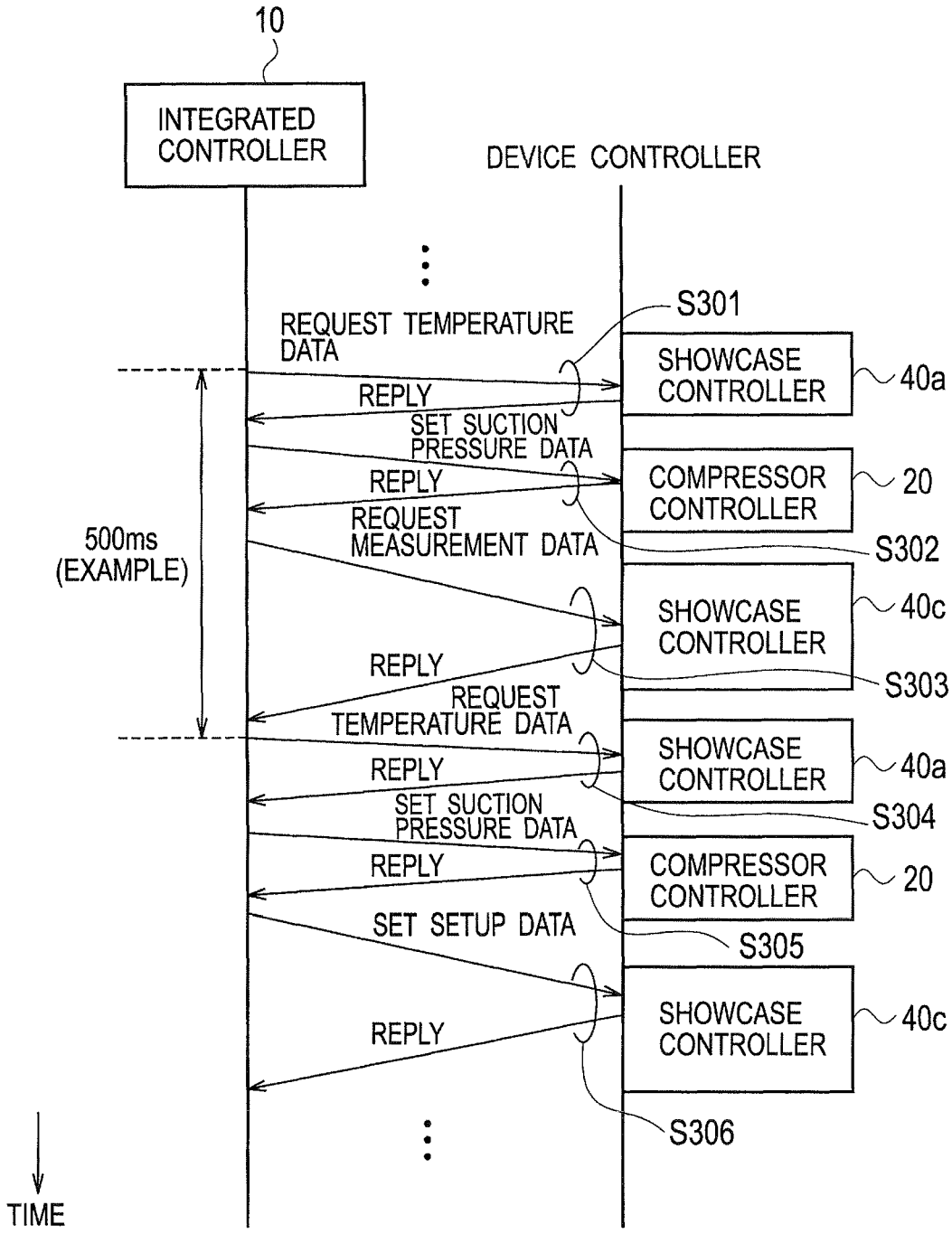
FIG. 10 is a sequential view showing a data communication sequence at the time of emergency operations according to the first embodiment.

FIG. 10 is a sequential view showing the data communication sequence at the time of emergency operations. Here, an explanation will be made in a case that a sensor within the showcase controlled by the showcase controller 40*a* is selected as the substitute sensor.

At step S301, the integrated controller 10 sends a request message requesting the temperature sensor value (measured data) to the showcase controller 40*a*. The showcase controller 40*a* sends a reply message to the integrated controller 10. At this time, the reply message format as shown at (b2) of FIG. 6 is used and the process of step S301 is completed within a short time.

At step S302, the integrated controller 10 sends a request message requesting to set up the control data (the suction pressure sensor supplementation value) to the compressor controller 20. The compressor controller 20 sends a reply message to the integrated controller 10. Each process of step S301 and step S302 corresponds to each item in priority 1 as described above.

At step S303, the integrated controller 10 sends a request message requesting the temperature sensor value (measured data) to the showcase controller 40*b*. The showcase controller 40*b* sends a reply message to the integrated controller 10. At this time, the reply message format as shown at (a2) of FIG. 6 is used.

At step S304 and step S305, the processes corresponding to each item in priority 1 again are carried out.

With the data communication sequence as shown in FIG. 10, obtaining the temperature sensor value of the substitute sensor and setting up the suction pressure sensor supplementation value can be carried out without depending on the number of the device controllers, and thus, the compressor controller 20 can control the compressor 51 appropriately at the time of emergency operations.

(4) Operations and Effect

According to this embodiment, when the abnormality of the suction pressure sensor 51*d* was detected by the abnormality detection unit 13, the control data generation unit 16 or the compressor controller 20 controls the compressor 51 using one of the temperature sensors 53*b*, 54*b*, and 55*b* . . . provided at the showcases 53, 54, and 55 . . . as the substitute sensor. Therefore, even when the abnormality occurred to the suction pressure sensor 51*d*, operations of the compressor 51 can be continued appropriately.

Also, it is not necessary to provide a number of sensors at the compressor 51, and therefore, an increase in the system size for the compressor 51 can be avoided. Moreover, in a case that the suction pressure sensor 51*d* is the only sensor provided at the compressor 51 and that an abnormality occurred to the suction pressure sensor 51*d*, the compressor 51 remains controllable, making it possible to continue appropriate operations of the compressor 51.

Further, because it is possible to divert the existing temperature sensors 53*b*, 54*b*, and 55*b* . . . provided at the existing showcases 53, 54, and 55 . . . to control the compressor 51 when the abnormality occurred to the suction pressure sensor 51*d*, it does not require an additional sensor and yet it makes it possible to handle when the abnormality occurred to the suction pressure sensor 51*d*.

According to the embodiment, the substitute sensor selection unit 14 selects a substitute sensor from among the temperature sensors 53*b*, 54*b*, and 55*b*, . . . using the correlation coefficient between the suction pressure sensor value and the temperature sensor value. Therefore, it is possible to select the substitute sensor that detects a showcase temperature having a high correlation with the suction pressure detected by the suction pressure sensor 51*d* from among the plurality of temperature sensors 53*b*, 54*b*, and 55*b*, . . . .

According to this embodiment, the communication control unit 12 accords the showcase controller controlling the showcase having the substitute sensor priority over the other showcase controllers as a subject of communication when the abnormality of the suction pressure sensor 51*d* was detected by the abnormality detection unit 13. Thus, the cycle to obtain the temperature sensor value detected by the substitute sensor can be shortened. As such, it makes it possible for the control data generation unit 16 or the compressor controller 20 to control the compressor 51 appropriately.

According to this embodiment, the communication control unit 12 obtains important data containing the temperature value detected by the substitute sensor before normal data containing the temperature values detected by the other temperature sensors when the abnormality of the suction pressure sensor 51*d* was detected by the abnormality detection unit 13. Thus, the cycle to obtain the temperature sensor value detected by the substitute sensor can be shortened. As such, it makes it possible for the control data generation unit 16 or the compressor controller 20 to control the compressor 51 appropriately.

The important data is not limited to the temperature sensor value detected by the substitute sensor which is data sent from the showcase controller to the integrated controller 10. For example, the sensor supplementation value generated by the control data generation unit 16 which is data sent from the integrated controller 10 to the compressor controller 20 also is the important data.

According to this embodiment, when the abnormality of the suction pressure sensor 51*d* was detected by the abnormality detection unit 13, the user can grasp that the abnormality with the suction pressure sensor 51*d* was detected and the substitute sensor was selected from among the plurality of temperature sensors 53*b*, 54*b*, and 55*b* . . . from the display screen such as shown in FIG. 7. Accordingly, it can prompt the user to repair the suction pressure sensor 51*d* and it can contribute to appropriate continued operations of the compressor 51.

Modified Example 1 of the First Embodiment

As described above, the compressor controller 20 controls the compressor 51 such that the error between the suction pressure sensor value and the target value for the suction pressure is decreased. Therefore, when the suction pressure sensor 51*d* is normal, the error is kept small. On the other hand, when an abnormality occurred to the suction pressure sensor 51*d*, the error increases.

In this modified example, the abnormality detection unit 13 determines whether or not the error exceeded a predetermined threshold and when the error exceeded the predetermined threshold, it determines that the abnormality occurred to the suction pressure sensor 51*d*. Therefore, the abnormality of the suction pressure sensor can be detected with high accuracy. Here, the abnormality detection unit 13 may determine whether or not the error exceeded the predetermined threshold based on an alarm or alert from the compressor controller 20.

Modified Example 2 of the First Embodiment

In the first embodiment described above, an example in which the control data generation unit 16 computes the suction pressure sensor supplementation value, and the communication control unit 12 sends and sets the suction pressure sensor supplementation value to the compressor controller 20.

However, the following control also is possible. In particular, the communication control unit 12 may send and set the temperature sensor value newly obtained from the substitute sensor and the target value for the showcase temperature. In this case, the compressor controller 20 controls the compressor 51 such that an error between the received temperature sensor value and the received target value is decreased. As such, according to this modified example, it becomes possible to omit the process of computing the suction pressure sensor supplementation value and thus it can reduce the burden to the integrated controller 10.

Modified Example 3 of the First Embodiment

In the first embodiment described above, an example in which the control data generation unit 16 computes the suction pressure sensor supplementation value using the regression line was described. However, it is not limited to the case in which the regression line is used to compute the suction pressure sensor supplementation value but it may also have a configuration in which the temperature sensor value of the substitute sensor is converted to the suction pressure sensor supplementation value by using a table. In particular, the control data generation unit 16 may obtain an appropriate suction pressure sensor supplementation value by using a past record table of the temperature sensor values and the suction pressure sensor values at the time of normal operations.

Second Embodiment

In this embodiment, a configuration in which a user can select the substitute sensor will be explained. In this embodiment, redundant explanations made in the above first embodiment will be omitted.

Figure 11:
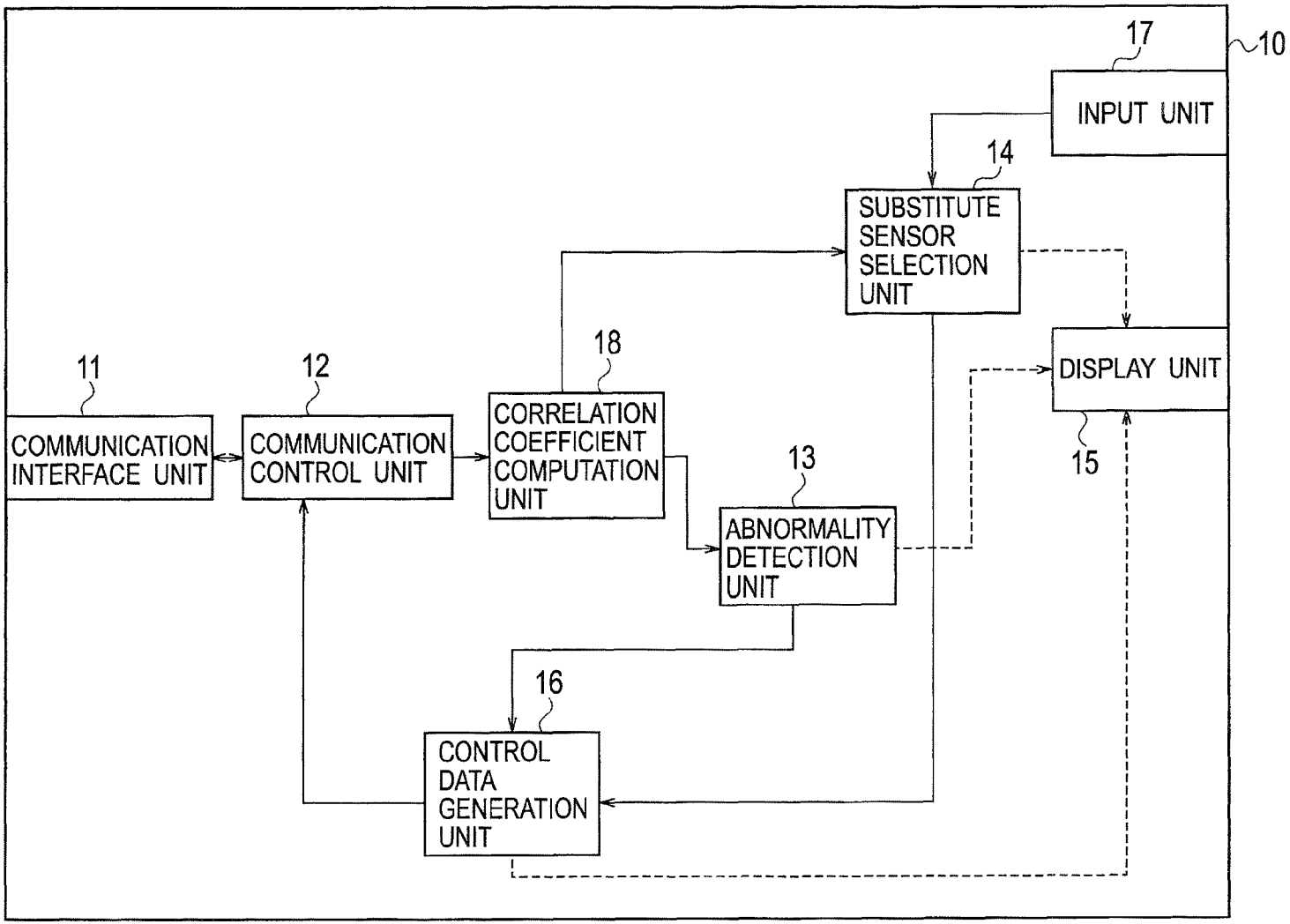
FIG. 11 is a functional block diagram of the integrated controller according to a second embodiment of the invention.

FIG. 11 is a functional block diagram of the integrated controller 10 according to this embodiment. As shown in FIG. 11, the integrated controller 10 has an input unit 17 that receives inputs from the user.

Figure 12:
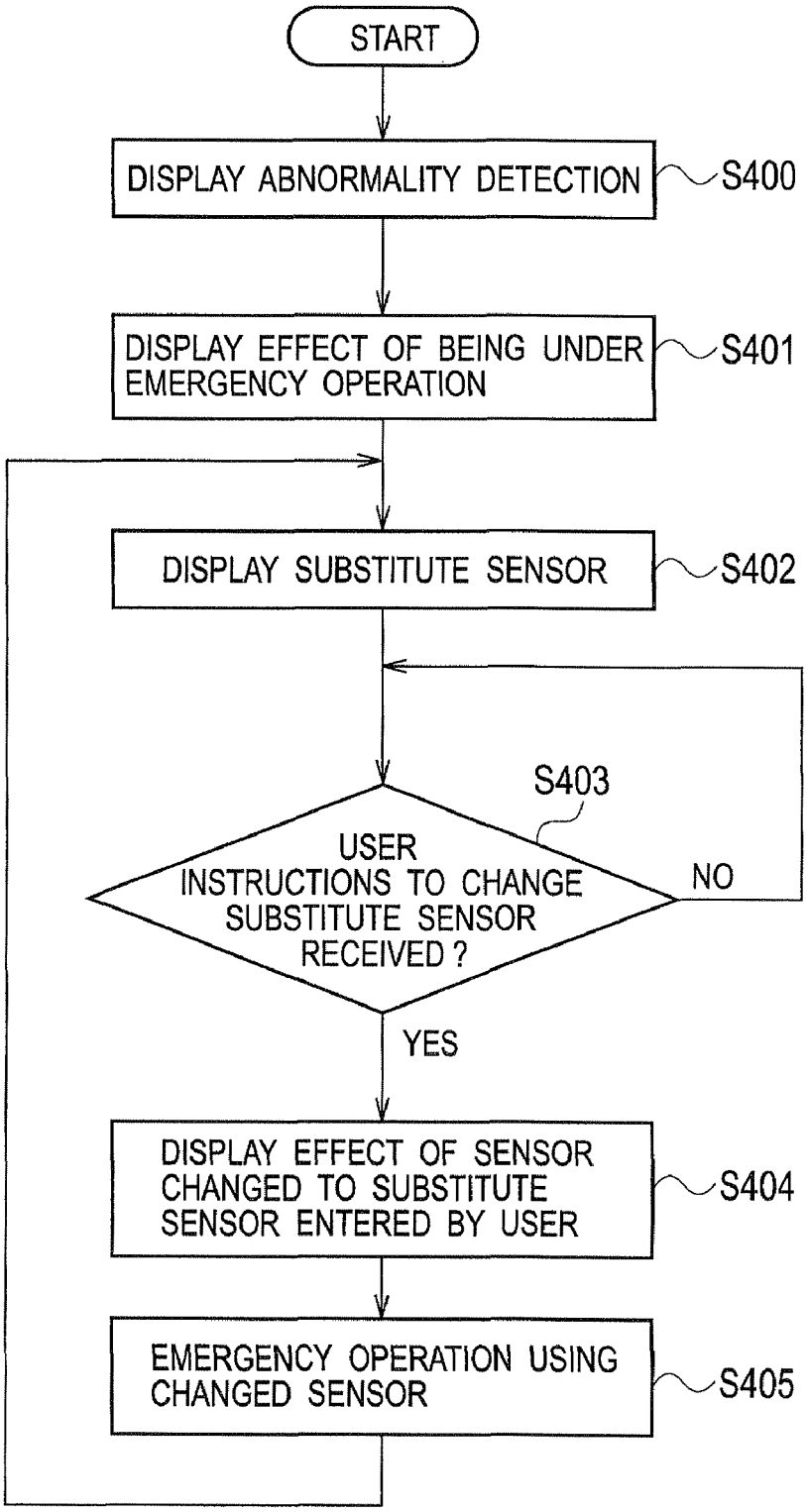
FIG. 12 is a flowchart showing operations of the integrated controller according to the second embodiment.

FIG. 12 is a flowchart showing operations of the integrated controller 10 according to this embodiment.

At step S400, the display unit 15 displays the effect that the abnormality was detected. At step S401, the display unit 15 displays the effect that it is under emergency operations. At step S402, the display unit 15 displays identifying information of the substitute sensor selected by the substitute sensor selection unit 14. Here, the display unit 15 may also display a list of the temperature sensors 53*b*, 54*b*, and 55*b* . . . to prompt the user to change the substitute sensor. In particular, in addition to displaying the effect that the substitute sensor was selected, the display unit 15 also may request the user to confirm whether the selected sensor is acceptable and prompt the user to accept or enter any changes to another sensor.

At step S403, the substitute sensor selection unit 14 determines whether or not instructions to change the substitute sensor was entered at the input unit 17. If the instructions to change the substitute sensor were entered, the process advances to step S404.

At step S404, the substitute sensor selection unit 14 switches to the emergency operations using the substitute sensor specified by the user. At step S402 thereafter, the display unit 15 displays the effect that the substitute sensor was changed to the one entered by the user. At step S405, the emergency operations using the changed sensor are carried out. As such, according to this embodiment, it becomes possible for the user to change the substitute sensor.

Third Embodiment

Next, the third embodiment of the invention will be explained. In this embodiment, redundant explanations made in the above first embodiment will be omitted.

(1) General Configuration of the Whole Cooling System

Figure 13:
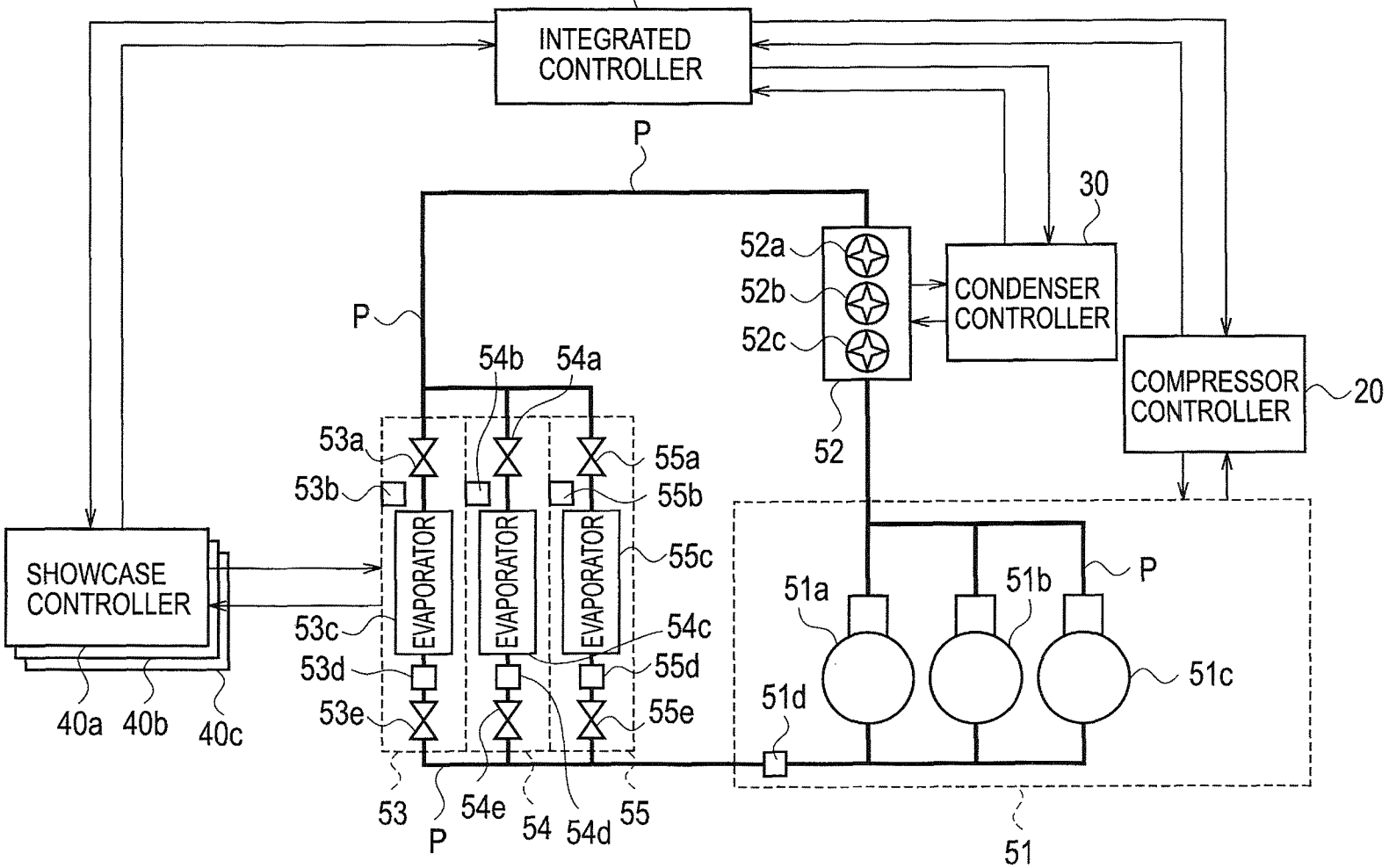
FIG. 13 is a general configuration diagram of the whole cooling system according to a third embodiment of the invention.

FIG. 13 is a general configuration view of the whole cooling system. In FIG. 13, illustration of certain components such as the remote monitoring server 102 that was shown in FIG. 1 is omitted.

As shown in FIG. 13, in the cooling system according to this embodiment, the showcases 53, 54, and 55 . . . are provided with temperature sensors 53*d*, 54*d*, and 55*d* . . . for detecting the refrigerant temperatures and flow controllers 53*e*, 54*e*, and 55*e* . . . . The integrated controller 10 obtains the sensor values outputted by the temperature sensors 53*d*, 54*d*, and 55*d* . . . from the showcase controllers 40*a*, 40*b*, and 40*c* . . . . Therefore, the temperature sensors 53*d*, 54*d*, and 55*d* . . . can be used as candidates for the substitute sensor.

Even if the same refrigerant piping P is used, the flow controllers 53*e*, 54*e*, and 55*e* . . . can vary the respective temperatures of the showcases 53, 54, and 55 . . . by adjusting the amount of the refrigerant that flows in the showcases 53, 54, and 55 . . . respectively. For the flow controllers 53*e*, 54*e*, and 55*e* . . . , a pressure regulator or an electronic expansion valve may be used.

The integrated controller 10 obtains information indicating the degree of refrigerant flow adjustment at the flow controllers 53*e*, 54*e*, and 55*e* . . . ("adjustment amount information") from the showcase controllers 40*a*, 40*b*, and 40*c* . . . .

The showcase temperature (such as the refrigerant temperature and the inside temperature) increases as the amount of the refrigerant that flows in the showcases 53, 54, and 55 . . . decreases. Thus, the temperature sensor values can be used as the adjustment amount information. Alternatively, if the system has the flow controllers 53*e*, 54*e*, and 55*e* . . . , the degree of their valve opening may be used as the adjustment amount information. It is also possible that if the integrated controller 10 sets the adjustment amount of the flow controllers 53*e*, 54*e*, and 55*e* . . . , such set values may be used as the adjustment amount information.

(2) Functional Block Diagram of the Integrated Controller

Figure 14:
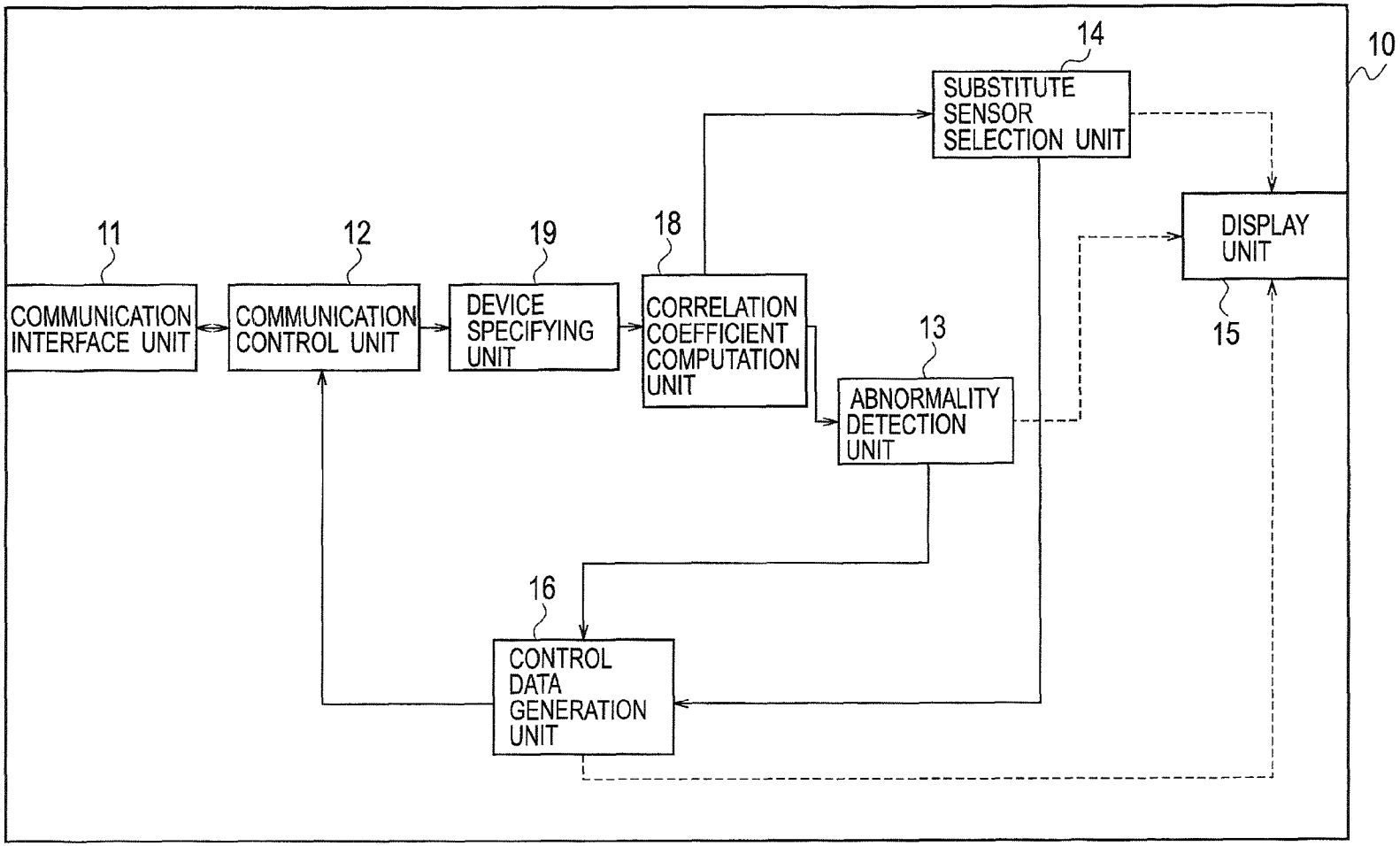
FIG. 14 is a functional block diagram of the integrated controller according to a third embodiment.

FIG. 14 is a functional block diagram of the integrated controller 10 according to this embodiment.

As shown in FIG. 14, the integrated controller 10 further includes a device specifying unit 19. The communication control unit 12 obtains the adjustment amount information as described above. Based on the adjustment amount information, the device specifying unit 19 specifies the showcase with the flow controller having an optimum value for the degree of adjusting the inside temperature.

Here, the optimum value is a value determined in advance depending on the configurations of the flow controllers 53*e*, 54*e*, and 55*e* . . . . For example, when the degree of valve opening for each of the flow controllers 53*e*, 54*e*, and 55*e* . . . is used as the adjustment amount information, the optimum value may be set as values such as 100% or 80%. Instead, when the temperature sensor value is used as the adjustment amount information, a smaller value or a temperature value within a predetermined range becomes the optimum value. In this embodiment, the device specifying unit 19 specifies the showcase having the lowest inside temperature or the showcase having the inside temperature within a predetermined range.

As an example, when the temperature sensor value for the inside temperature is used as the adjustment amount information, it is assumed that the following data was obtained.

Showcase A: −2° C.
Showcase B: −2° C.
Showcase C: −5° C.
Showcase D: −3° C.
Showcase E: −5° C.
Showcase F: −5° C.

Here, the larger the valve opening is at the flow controllers 53*e*, 54*e*, and 55*e* . . . , the lower the inside temperature becomes. In other words, the showcase having a lower inside temperature has a larger valve opening at the flow controllers 53*e*, 54*e*, and 55*e* . . . , which means that it has a higher correlation with the suction pressure. Therefore, the device specifying unit 19 specifies the showcases having the lowest inside temperatures, that is, the showcases C, E, and F. Alternatively, if the temperature within the predetermined range is for example −6° C. to −4° C., similarly the showcases C, E, and F are specified.

The substitute sensor selection unit 14 determines the substitute sensor using the processes described in the first embodiment from among each temperature sensor provided at the showcases C, E, and F that were specified by the device specifying unit 19.

As such, by limiting the showcases that become a subject of the substitute sensor selection, more appropriate selection of the substitute sensor is achieved. Also, in addition to the selection of the substitute sensor, by limiting the showcases that become a subject of computing the correlation coefficient in abnormality detection processing by the abnormality detection unit 13, accuracy of the abnormality detection also can be increased.

(4) Operations and Effect

According to this embodiment, the communication control unit 12 obtains the temperature sensor value as the adjustment amount information. In other words, the inside temperature becomes lower as the valve opening at the flow controllers 53*e*, 54*e*, and 55*e* . . . is increased, and the correlation between the suction pressure and the inside temperature becomes higher.

Therefore, the device specifying unit 19 specifies a showcase having an optimum value of the inside temperature, more specifically, a showcase having the lowest inside temperature or having the inside temperature within a predetermined range, from among the showcases 53, 54, and 55 . . . . The specified showcase has the inside temperature that has the highest correlation with the suction pressure.

The substitute sensor selection unit 14 determines the substitute sensor by using the correlation coefficient from the temperature sensor provided at the showcase that was specified by the device specifying unit 19. Therefore, it becomes possible to select the substitute sensor from the temperature sensor provided at the showcase having the inside temperature that has the highest correlation with the suction pressure from among the showcases 53, 54, and 55 . . . , and thus, a substitute sensor that is more appropriate can be selected.

Other Embodiments

As described above, the invention was described using the embodiments. However, the descriptions and the drawings that constitute a part of this disclosure should not be regarded as being restrictive. From this disclosure, various alternative embodiments, examples, and operative technologies become apparent for one skilled in the art.

(1) Modified Example of the Refrigerant Circulation Circuit

Figure 15:
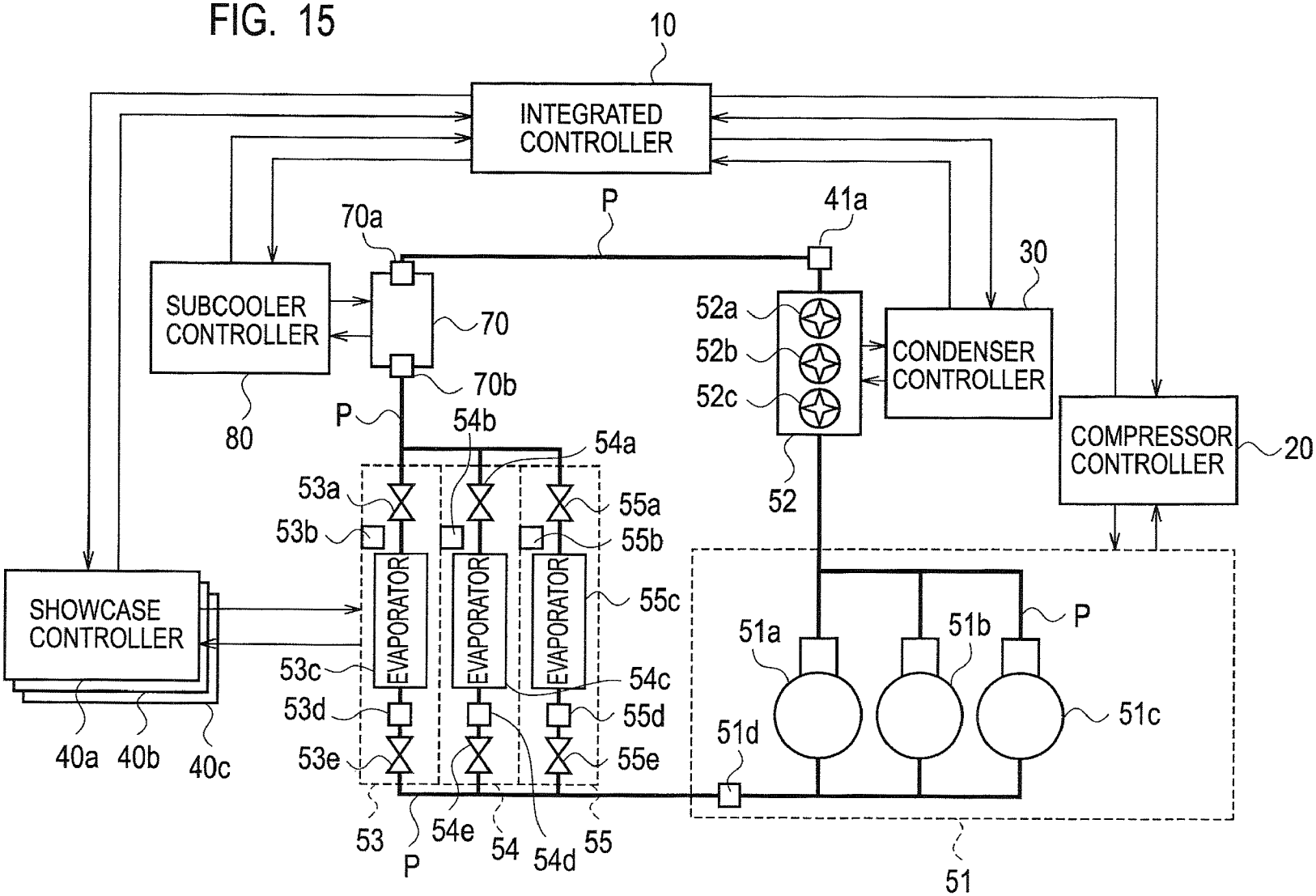
FIG. 15 is a general configuration diagram of the whole cooling system according to other embodiments.

Various modifications to the refrigerant circulation circuit as described above are possible. FIG. 15 is a view for explaining a modified example of the refrigerant circulation circuit. In FIG. 15, a sub-cooler 70 connected by the refrigerant piping P is provided between the condenser 52 and the showcases 53, 54, and 55 . . . . The sub-cooler 70 is used for improving the cooling ability of the showcases 53, 54, and 55 . . . . In this embodiment, each of the compressor 51, the condenser 52, the showcases 53, 54, and 55 . . . , and the sub-cooler 70 is a constituent device that constitutes the refrigerant circulation circuit.

The sub-cooler 70 is controlled by a sub-cooler controller 80 that communicates with the integrated controller 10. Sensors 70*a* and 70*b* are provided at the sub-cooler 70. The sensors 70*a* and 70*b* detect for example the temperature of the refrigerant that flows in the sub-cooler 70. The integrated controller 10 obtains the sensor values outputted by the sensors 70*a* and 70*b* from the sub-cooler controller 80. Thus, the sensors 70*a* and 70*b* can be used as candidates for the substitute sensor.

At the discharge side of the condenser 52, a sensor 41*a* for detecting the discharge pressure or the discharge temperature of the condenser 52 is provided. The integrated controller 10 obtains the sensor value outputted by the sensor 41*a* from the condenser controller 30. Thus, the sensor 41*a* can be used as a candidate for the substitute sensor.

Figure 16:
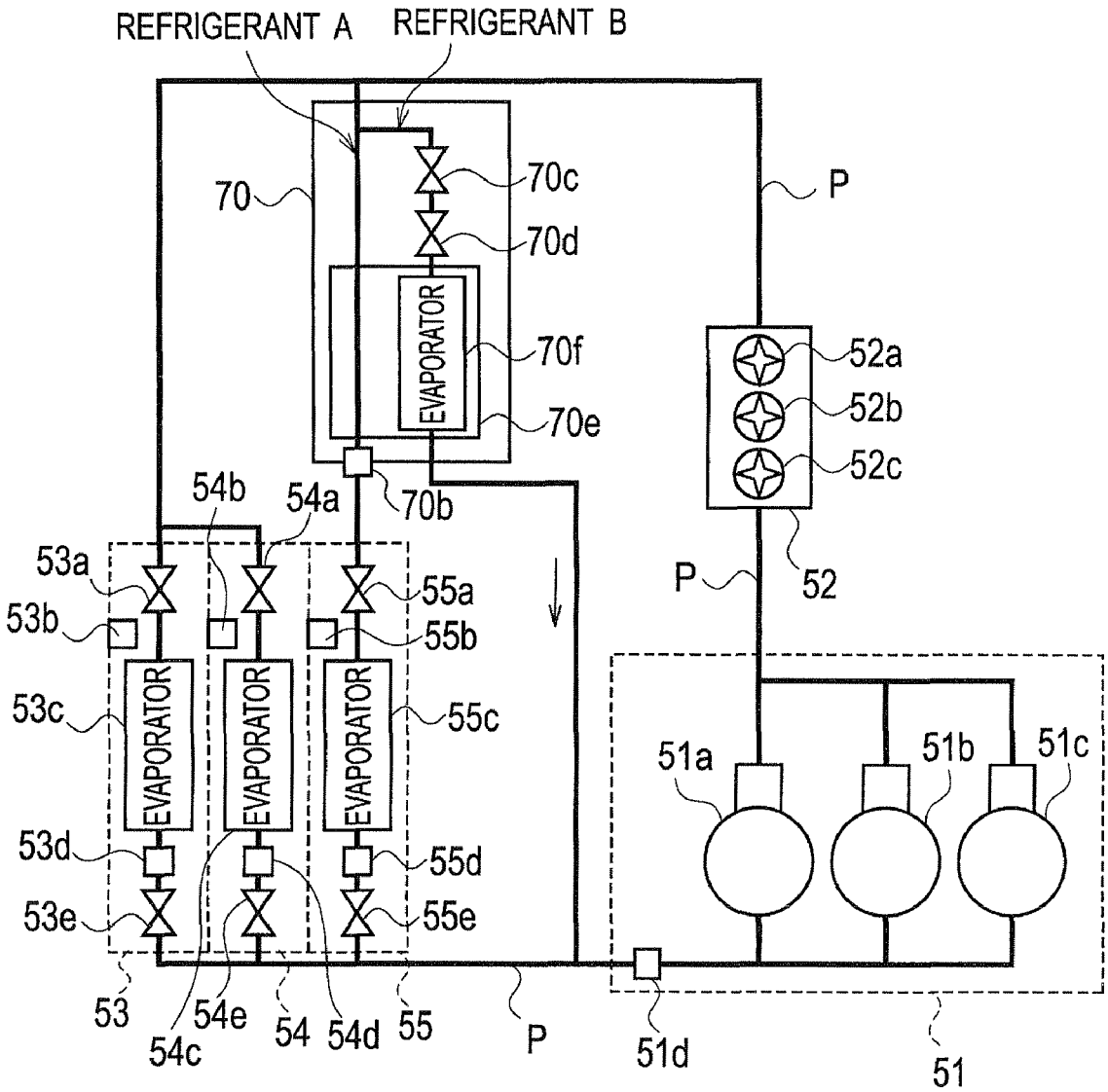
FIG. 16 is a view showing a specific example of a subcooler according to other embodiments.

FIG. 16 is a view showing an example of the sub-cooler 70. As shown in FIG. 16, the sub-cooler 70 is a device for super-cooling the refrigerant that flows a showcase, such as the showcase 55 for freezing, in which a cooling ability higher than the other showcases (such as those for refrigeration) is required.

In the example of FIG. 16, the sub-cooler 70 has a valve 70*c*, an expansion valve 70*d*, an evaporator unit 70*e*, and a sensor 70*b*. The valve 70*c* takes in part of the refrigerant B to the expansion valve 70*d*. The evaporator unit 70*e* has an evaporator 70*f* and cools the refrigerant A by the thermal exchange using the refrigerant B. The cooled refrigerant A is lead to the showcase 55. The sensor 70*b* detects the temperature of the refrigerant A after being cooled by the evaporator unit 70*e*. A compressor for compressing the refrigerant B discharged from the evaporator 70*f* also may be provided.

(2) Modified Examples of the Method to Set the Priority and Priority Order

The priority and priority order as described above can be set or changed by the user. FIGS. 17A and 17B are views showing specific examples of the priority and priority order.

FIG. 17A shows an instance in which the priorities and priority orders are set up depending on the type of the merchandises. As shown in FIG. 17A, it is preferable that a higher priority is accorded to a showcase that requires ensuring freshness and precise temperature control.

FIG. 17B shows an instance in which the priorities and priority orders are set up depending on the type of the device controllers. When for example it is desired that the compressor 51 is monitored constantly, as shown in FIG. 17B, such a setup is possible to accord a higher priority to the compressor controller and to lower the priority of the condenser controller.

(3) Modified Examples of the Controllers

In the embodiments as described above, the abnormality detection unit 13, the substitute sensor selection unit 14, and the control data generation unit 16 were provided in the integrated controller 10. However, a system configuration also is possible in which each functional block such as the abnormality detection unit 13, the substitute sensor selection unit 14, and the control data generation unit 16 is scattered in each device controller.

(4) Examples of Other Applications

In the embodiments as described above, a system configuration to refrigerate and freeze merchandises in a showcase that is placed such as in a store was described. However, the invention also is applicable to an air conditioning system for an indoor space such as a store.

Figure 18B:
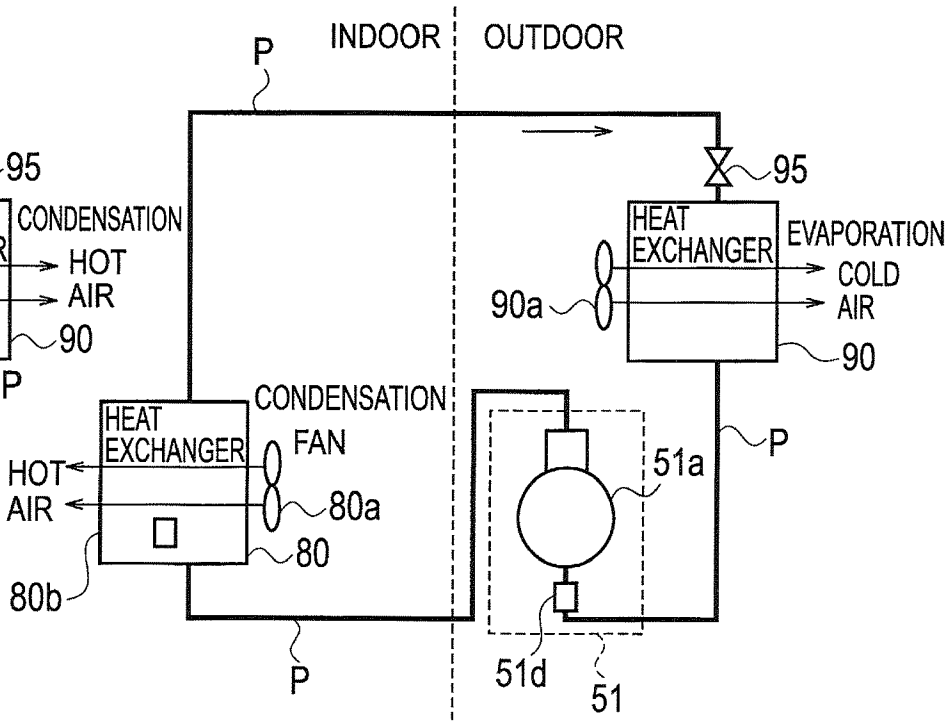
FIGS. 18A and 18B are views for explaining examples of an application of the invention to an air conditioning system.
Figure 18A:
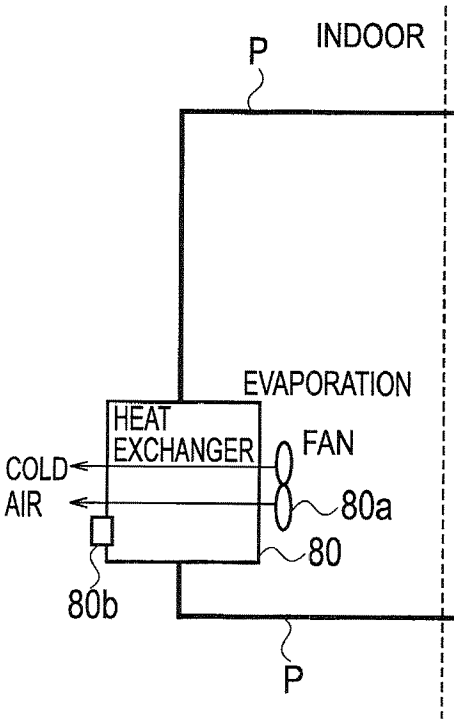

FIGS. 18A and 18B are views for explaining examples of an application of the invention to the air conditioning system. In FIGS. 18A and 18B, each of a compressor 51, heat exchangers 80 and 90, and an expansion valve 95 is a constituent device that constitutes the refrigerant circulation circuit and is connected by refrigerant piping P. In the air conditioning system, at the time of refrigerated air conditioning, the refrigerant is circulated as shown in FIG. 18A. On the other hand, at the time of air heating, the refrigerant path is switched and the refrigerant is circulated as shown in FIG. 18B.

A temperature sensor 80*b* for detecting the indoor temperature is provided at the indoor-side heat exchanger 80, and when an abnormality occurred to the sensor 51*d* for the compressor 51, the temperature sensor 80*b* provided at the heat exchanger 80 can be used as the substitute sensor.

(5) Computer Program

It is possible to implement each operational flow as described in the above embodiments as a computer program and make it executed such as by a computer functioning as the integrated controller 10.

Figure 19:
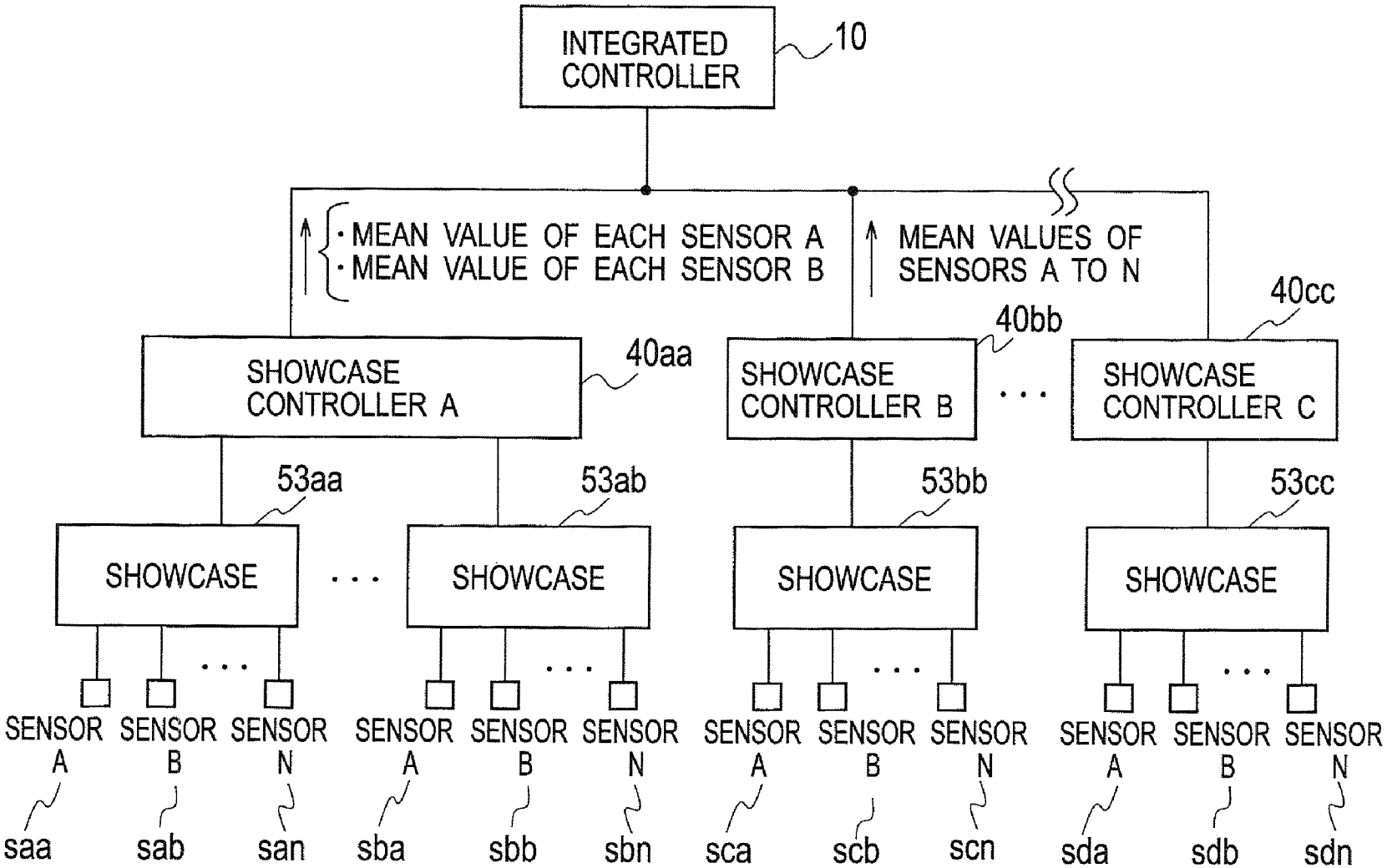
FIG. 19 is a view for explaining data transmitted from showcase controllers according to other embodiments.

(6) Modified Examples of the Method to Obtain Measurement Values of the Constituent Device Sensors FIG. 19 is a view for explaining the connection among the showcase controllers, showcases, and each constituent device sensor in FIGS. 1, 13, 15, and 16. In FIG. 19, a showcase controller A (40*aa*), a showcase controller B (40*bb*), and a showcase controller C (40*cc*) are connected to the integrated controller 10. To the showcase controller A, a plurality of constituent device sensors, that is, a sensor A (saa), a sensor B (sab), . . . and a sensor N (san) housed in the showcase 53*aa*, and a sensor A (sba), a sensor B (sbb), . . . and a sensor N (sbn) housed in the showcase 53*ab* are connected. To the showcase controller B, a plurality of constituent device sensors, that is, a sensor A (sca), a sensor B (scb), . . . and a sensor N (scn) housed in the showcase 53*bb* are connected. To the showcase controller C, a plurality of constituent device sensors, that is, a sensor A (sda), a sensor B (sdb), . . . and a sensor N (sdn) housed in the showcase 53*cc* are connected. Such constituent device sensors A to N are for example a plurality of temperature sensors and pressure sensors provided at the showcases.

In this case, not only that the sensor values of respective constituent device sensors A to N themselves are sent to the integrated controller 10, but also for some of the constituent device sensors A to N, for example the statistical value may be sent to the integrated controller 10. As the statistical value, for example a mean value, a variance value, or a standard deviate may be used.

More specifically, in the example of FIG. 19, from the showcase controller A, for each of the sensors A and sensors B housed in the plurality of showcases, averaged values of all the sensor values for these sensors are sent, and for sensors such as the sensors N, each value itself is sent without averaging. Thus, as to the sensor values, the amount of transmitted data from the showcase controller A can be decreased as much as it was averaged in a lump compared with the case in which the averaging was not performed. Also, the communication frequency from the showcase controller A to the integrated controller 10 can be decreased.

From the showcase controller B, only the averaged value is sent for each value of the sensors A to N housed in the showcase 53*bb*. Therefore, as to the sensor values, only the one mean value is sent and thus the amount of transmitted data can be decreased. Also, the communication frequency from the showcase controller A to the integrated controller 10 can be decreased.

From the showcase controller C, each value of the sensors A to N itself is sent and there is no decrease in the amount of transmitted data.

In averaging the data, not only that the sensor values of the plurality of sensors are simply averaged but also for example weighted averaging for each sensor may be performed from the perspective of accuracy of the mean value. For example, the sensor value for the sensor on the refrigerant piping closer to the compressor may be made to have a higher weight.

As to the selection of the computation at the time of averaging, for example sensor groups may be classified based on the type of the constituent device sensors housed in the showcases (such as the temperature sensor and pressure sensor), the intended purpose of the sensors (in other words, the intended purposes vary depending on whether it is placed at the refrigerant piping at a position prior to the evaporator, at the refrigerant piping at a position subsequent to the evaporator, or inside the showcase), the type of the showcases housing the sensors (such as the refrigeration showcase and freezer showcase), or the preset temperatures of the showcases housing the sensors; and a sensor mean value may be computed for each group of such classified sensors.

The integrated controller can take the correlation between the suction pressure sensor value and the mean value of these constituent device sensors, and when it was determined that the suction pressure sensor is abnormal, selects the mean value having the most correlation as the sensor value of the substitute sensor for the suction pressure sensor, and controls the compressor using the sensor value of the substitute sensor.

As such, the data amount and the communication frequency of the communication data between the showcase controllers and the integrated controller can be decreased by sending the statistical values for the sensor values such as the averaged sensor value rather than sending sensor values of all the sensors connected to the showcase controllers.

(7) Modified Examples of the Selection Method of the Substitute Sensor

For the substitute sensor of the suction pressure sensor, a constituent device sensor that is closer in distance with the suction pressure sensor on the refrigerant piping may be preferentially selected. For example, in the example of FIG. 13, the compressor may be controlled by extracting the sensors that are closest to the compressor or the suction pressure sensor 51*d* in distance, such as the sensors 53*d*, 54*d*, and 55*d* at a position subsequent to the evaporators from the group of the plurality of constituent device sensors in the plurality of showcases, taking the correlation between the sensor value of each of the sensors and the suction pressure sensor value, and when the abnormality of the suction pressure sensor was detected, selecting the sensor having the most correlation from among the above extracted sensors as the substitute sensor, and using the sensor value of the substitute sensor.

Also, since the constituent device sensor having the lowest pressure value of the refrigerant can be said to be closest to the compressor, such a sensor may be selected as the substitute sensor.

As such, the substitute sensor can be selected with higher accuracy by selecting the substitute sensor for the suction pressure sensor from among the constituent device sensors that are closer in distance to the suction pressure sensor on the refrigerant piping or the constituent device sensors having the lowest refrigerant pressure.

According to the invention, it is possible to provide a cooling system, control device, and control program in which even when a number of sensors are not provided at the compressor, when an abnormality occurred to the sensor provided at the compressor, operations of the compressor can be appropriately continued by utilizing a sensor of other devices.

The present invention may be embodied in other specific forms without departing from the spirit or essential characteristics thereof. The embodiments are therefore to be considered in all respects as illustrative and not restrictive, the scope of the present invention being indicated by the appended claims rather than by the foregoing description, and all changes that come within the meaning and range of equivalency of the claims therefore are intended to be embraced therein.

What is claimed is:

1. A cooling system, comprising:

a compressor for compressing a refrigerant;

at least one constituent device which is a separate device from the compressor and that constitutes a refrigerant circulation circuit together with the compressor;

a compressor sensor for detecting a first physical value as a first sensor value, the first physical value being a physical value of the refrigerant;

a plurality of constituent device sensors each for detecting a second physical value as a second sensor value, each of the second physical values being a physical value having a close correlation with the first physical value either by being affected by the first physical value or by affecting the first physical value;

a compressor control unit for controlling the compressor using the compressor sensor at a time of normal operations;

an abnormality detection unit for detecting an abnormality of the compressor sensor;

a correlation coefficient-computing unit that computes a correlation coefficient indicating a correlation between the second sensor value detected by each of the constituent device sensors and the first sensor value for each second sensor value;

a substitute sensor selection unit for selecting a substitute sensor for controlling the compressor when an abnormality is detected by the abnormality detection unit;

an adjustment mechanism provided at each of the constituent devices for adjusting a corresponding second physical value; and a device specifying unit for specifying a constituent device with the adjustment mechanism having an optimum value of a degree of adjusting the second physical value from among the constituent devices based on adjustment amount information indicating the degree of adjusting the second physical value;

wherein the compressor control unit controls the compressor using the constituent device sensor in place of the compressor sensor at a time of abnormality detection by the abnormality detection unit; and wherein the substitute sensor is a constituent device sensor that detects the second sensor value having the most correlation with the first sensor value among the constituent device sensors based on the correlation coefficient computed by the correlation coefficient computation unit using a correlation function.

2. The cooling system of claim 1, wherein the substitute sensor selection unit selects the substitute sensor by using the correlation coefficient computed at the correlation coefficient computation unit using the correlation function from the constituent device sensor provided at the constituent device that is specified by the device specifying unit.

3. A cooling system, comprising:

a compressor for compressing a refrigerant;

at least one constituent device which is a separate device from the compressor and that constitutes a refrigerant circulation circuit together with the compressor;

a compressor sensor for detecting a first physical value as a first sensor value, the first physical value being a physical value of the refrigerant;

a plurality of constituent device sensors each for detecting a second physical value as a second sensor value, each of the second physical values being a physical value having a close correlation with the first physical value either by being affected by the first physical value or by affecting the first physical value;

a compressor control unit for controlling the compressor using the compressor sensor at a time of normal operations;

an abnormality detection unit for detecting an abnormality of the compressor sensor;

a correlation coefficient-computing unit that computes a correlation coefficient indicating a correlation between the second sensor value detected by each of the constituent device sensors and the first sensor value for each second sensor value;

a substitute sensor selection unit for selecting a substitute sensor for controlling the compressor when an abnormality is detected by the abnormality detection unit;

a communication control unit that sends the second sensor value detected by each of the constituent device sensors to the compressor control unit; and a plurality of device control units for controlling the constituent devices, wherein the communication control unit obtains the second sensor values from the device control units by communicating with the device control units, wherein when an abnormality is detected by the abnormality detection unit, the communication control unit accords a device control unit controlling the constituent device having the substitute sensor priority over the other device control units, and wherein when an abnormality is detected by the abnormality detection unit, the communication control unit extracts temperature sensor value and sensor supplementation value including the second sensor value detected by the substitute sensor, accords the temperature sensor value and sensor supplementation value priority over normal data including the second sensor value detected by the other constituent device sensors, and sends the temperature sensor value and sensor supplementation value to the compressor control unit more frequently than the normal data;

wherein the compressor control unit controls the compressor using the constituent device sensor in place of the compressor sensor at a time of abnormality detection by the abnormality detection unit; and wherein the substitute sensor is a constituent device sensor that detects the second sensor value having the most correlation with the first sensor value among the constituent device sensors based on the correlation coefficient computed by the correlation coefficient computation unit using a correlation function.

* * * * *